US007064493B2

(12) United States Patent
Konishi

(10) Patent No.: US 7,064,493 B2
(45) Date of Patent: Jun. 20, 2006

(54) COLD CATHODE ELECTRIC FIELD ELECTRON EMISSION DISPLAY DEVICE

(75) Inventor: Morikazu Konishi, Kanagawa (JP)

(73) Assignee: Sony Corporation (JP)

( * ) Notice: Subject to any disclaimer, the term of this patent is extended or adjusted under 35 U.S.C. 154(b) by 143 days.

(21) Appl. No.: 10/503,991

(22) PCT Filed: Mar. 27, 2003

(86) PCT No.: PCT/JP03/03800

§ 371 (c)(1),
(2), (4) Date: Aug. 9, 2004

(87) PCT Pub. No.: WO03/094193

PCT Pub. Date: Nov. 13, 2003

(65) Prior Publication Data

US 2005/0082964 A1 Apr. 21, 2005

(30) Foreign Application Priority Data

May 1, 2002 (JP) ..... 2002-129606

(51) Int. Cl.
*G09G 3/10* (2006.01)

(52) U.S. Cl. ..... 315/169.1; 315/169.2

(58) Field of Classification Search .. 315/169.1–169.4, 315/160; 313/306–307, 310, 506, 509, 581, 313/584, 586

See application file for complete search history.

(56) References Cited

U.S. PATENT DOCUMENTS 6,791,278 B1 * 9/2004 Russ et al. ..... 315/169.3
6,873,118 B1 * 3/2005 Russ et al. ..... 315/169.3

FOREIGN PATENT DOCUMENTS

| | | | |
|---|---|---|---|
| EP | 1 132 940 A2 | | 9/2001 |
| JP | 3-64077 B2 | | 10/1991 |
| JP | 6-12974 A | * | 1/1994 |
| JP | 2832919 B2 | | 12/1998 |
| JP | 3168795 B2 | | 3/2001 |
| JP | 2001-229805 A | * | 8/2001 |

* cited by examiner

*Primary Examiner*—Trinh Vo Dinh
(74) *Attorney, Agent, or Firm*—Rader, Fishman & Grauer PLLC; Ronald P. Kananen

(57) ABSTRACT

A cold cathode field emission display comprising at least (A) a display panel having a cathode panel CP provided with a plurality of electron-emitting regions EA and an anode panel AP provided with a phosphor layer 31 and an anode electrode 34, said cathode panel and said anode panel being bonded to each other in their circumferential regions, (B) a focus-electrode control circuit 41, (C) a resistance element R, and (D) a capacitor C, in which the focus electrode 15 formed in the electron-emitting region EA is connected to a first voltage-output portion 41A of the focus-electrode control circuit 41 through the resistance element R, and the focus electrode 15 is further connected to a second voltage-output portion 41B of the focus-electrode control circuit 41 through the capacitor C.

31 Claims, 32 Drawing Sheets

AP
30
10
31
12
16
EA
CP
15
32
33
13
19
14
34
18
17
11
EFFECTIVE FIELD
35
ANODE-ELECTRODE CONTROL CIRCUIT
$R_0$
43
41
41A
R
C
FOCUS-ELECTRODE CONTROL CIRCUIT
41B
GATE-ELECTRODE CONTROL CIRCUIT
42
40
CATHODE-ELECTRODE CONTROL CIRCUIT

[STEP-130]

[STEP-140]

[STEP-150]

[STEP-160]

[STEP-230]

[STEP-250]

[STEP-260]

[STEP-270]

AP
30
10
31
12
16
20
EA
CP
21
22
32
23
33
13
19
14
34
18
11
17
EFFECTIVE FIELD
35
ANODE-ELECTRODE CONTROL CIRCUIT
$R_0$
41
41A
R
43
FOCUS-ELECTRODE CONTROL CIRCUIT
41B
GATE-ELECTRODE CONTROL CIRCUIT
42
40
CATHODE-ELECTRODE CONTROL CIRCUIT

[STEP-320]

[STEP-330]

[STEP-340]

[STEP-350]

AP
30
10
31
32
33
34
35
212
13
215
216
EA
CP
EFFECTIVE FIELD
19
214
218
217
11
ANODE-ELECTRODE CONTROL CIRCUIT
43
$R_0$
41
FOCUS-ELECTRODE CONTROL CIRCUIT
R
GATE-ELECTRODE CONTROL CIRCUIT
42
40
CATHODE-ELECTRODE CONTROL CIRCUIT

COLD CATHODE ELECTRIC FIELD ELECTRON EMISSION DISPLAY DEVICE

TECHNICAL FIELD

The present invention relates to a cold cathode field emission display and, more specifically, to a cold cathode field emission display with a focus electrode in which an increase in potential in the focus electrode can be suppressed even if an abnormal discharge takes place.

BACKGROUND ART

In the fields of displays for use in television receivers and information terminals, studies have been made for replacing conventionally mainstream cathode ray tubes (CRT) with flat-panel displays that are to comply with demands for a decrease in thickness, a decrease in weight, a larger screen and a high fineness. Such flat panel displays include a liquid crystal display (LCD), an electroluminescence display (ELD), a plasma display panel (PDP) and a cold cathode field emission display (FED). Of these, a liquid crystal display is widely used as a display for an information terminal. For applying the liquid crystal display to a floor-type television receiver, however, it still has problems to be solved concerning a higher brightness and an increase in size. In contrast, a cold cathode field emission display uses cold cathode field emission devices (to be sometimes referred to as a "field emission device" hereinafter) capable of emitting electrons from a solid into a vacuum on the basis of a quantum tunnel effect without relying on thermal excitation, and it is of great interest from the viewpoints of a high brightness and a low power consumption.

FIGS. 28 and 29 shows a cold cathode field emission display to which the field emission devices are applied (to be sometimes referred to as a "display" hereinafter). FIG. 28 is a schematic partial end view of the display, and FIG. 29 is a schematic partial perspective view of a cathode panel CP when the cathode panel CP and an anode panel AP are disassembled.

The field emission device shown in FIG. 28 is a so-called Spindt-type field emission device having a conical electron-emitting portion. Such a field emission device comprises a cathode electrode 11 formed on a supporting member 10, an insulating layer 112 formed on the supporting member 10 and the cathode electrode 11, a gate electrode 13 formed on the insulating layer 112, an opening portion 117 formed through the gate electrode 13, an opening portion 118 formed through the insulating layer 112, and a conical electron-emitting portion 19 formed on the cathode electrode 11 positioned in the bottom portion of the opening portion 118. Generally, the cathode electrode 11 and the gate electrode 13 are each formed in the form of a stripe in directions in which the projection images of these two electrodes cross each other at right angles. Generally, a plurality of field emission devices are arranged in a region (corresponding to one pixel, where the region will be called an "overlap region" or an "electron-emitting region EA" hereinafter) where the projection images of the above two electrodes overlap. Further, generally, such electron-emitting regions EA are arranged in the form of a two-dimensional matrix within an effective field (which works as an actual display portion) of the cathode panel CP.

The anode panel AP comprises a substrate 30, a phosphor layer 31 (31R, 31B and 31G) which is formed on the substrate 30 and has a predetermined pattern, and an anode electrode 34 formed thereon. A black matrix 32 is formed on the substrate 30 between one phosphor layer 31 and another phosphor layer 31, and a separation wall 33 is formed on the black matrix 32.

Each pixel is constituted of a group of the field emission devices formed on the electron-emitting region EA which is an overlap region of the cathode electrode 11 and the gate electrode 13 of the cathode panel side and the phosphor layer 31 of the anode panel side arranged so as to face the electron-emitting region EA. In the effective field, such pixels are arranged on the order, for example, of hundreds of thousands to several millions.

The anode panel AP and the cathode panel CP are arranged such that the electron-emitting regions EA and the phosphor layers 31 are opposed to each other, and the anode panel AP and the cathode panel CP are bonded to each other in their circumferential portions through a frame 35, whereby the display is produced. In an ineffective field which surrounds the effective field and where a peripheral circuit for selecting pixels is formed, a through-hole (not shown) for vacuuming is provided, and a tip tube (not shown) is connected to the through-hole and sealed after vacuuming. That is, a space surrounded by the anode panel AP, the cathode panel CP and the frame 35 is in a vacuum state.

A relatively negative voltage is applied to the cathode electrode 11 from a cathode-electrode control circuit 40, a relatively positive voltage is applied to the gate electrode 13 from a gate-electrode control circuit 42, and a positive voltage having a higher level than the voltage applied to the gate electrode 13 is applied to the anode electrode 34 from an anode-electrode control circuit 43. Between the anode electrode control circuit 43 and the anode electrode 34 is generally provided a resistance member $R_0$ (having a resistance value of 1 MΩ in a shown example) for preventing an over-current and discharging.

When such a display is used for displaying on its screen, a scanning signal is inputted to the cathode electrode 11 from the cathode-electrode control circuit 40, and a video signal is inputted to the gate electrode 13 from the gate-electrode control circuit 42. Due to an electric field generated when a voltage is applied between the cathode electrode 11 and the gate electrode 13, electrons are emitted from the electron-emitting portion 19 on the basis of a quantum tunnel effect, and the electrons are attracted toward the anode electrode 34 and collide with the phosphor layer 31. As a result, the phosphor layer 31 is excited to emit light, and a desired image can be obtained. That is, the working of the display is controlled, in principle, by a voltage applied to the gate electrode 13 and a voltage applied to the electron-emitting portion 19 through the cathode electrode 11.

In the field emission device having the above structure, electrons are emitted from the electron-emitting portion 19 with certain angles from the normal of the electron-emitting portion 19. As a result, electrons emitted from the electron-emitting portion 19 may not collide with the opposed phosphor layer 31 but collide with a phosphor layer 31 adjacent to the opposed phosphor layer 31. When such a phenomenon takes place, the brightness is decreased and an optical crosstalk occurs between contiguous pixels.

For preventing the occurrence of the above phenomenon, there has been proposed a field emission device provided with a focus electrode 215 as shown in the schematic partial end view of FIG. 30. In this field emission device, a second insulating layer 214 is further provided on a gate electrode 13 and a first insulating layer 212, and the focus electrode 215 is formed on the second insulating layer 214. The focus electrode 215 has the form of one sheet covering the effective field. Reference numeral 216 shows a first opening portion formed through the focus electrode 215 and the second insulating layer 214, reference numeral 217 shows a second opening portion formed through the gate electrode 13, and reference numeral 218 shows a third opening portion formed through the first insulating layer 212. A relatively negative voltage (for example, 0 volt) is applied to the focus electrode 215 from a focus-electrode control circuit 41. When provided, the focus electrode 215 can converge the path of electrons that are emitted from the first opening portion 216 toward the anode electrode 34. Between the focus electrode 215 and the focus-electrode control circuit 41 is provided a resistance element R.

Meanwhile, in the above display, the distance between the anode panel AP and the cathode panel CP is approximately 1 mm at the largest, so that an abnormal discharge (spark discharge) is liable to take place between the field emission device of the cathode panel (more specifically, the focus electrode 215) and the anode electrode 34 of the anode panel AP.

In a mechanism in which a discharge takes place in a vacuum space, first, electrons and ions that are emitted from the field emission device under a strong electric field work as a trigger to cause a small-scaled discharge. And, energy is supplied to the anode electrode 34 from the anode-electrode control circuit 43, the anode electrode 34 is locally temperature-increased, and an occluded gas inside the anode electrode 34 is released, or a material constituting the anode electrode 34 is caused to vaporize, so that the small-scaled discharge presumably grows to be an abnormal discharge. Besides the anode-electrode control circuit 43, energy accumulated in an electrostatic capacity formed between the anode electrode 34 and the field emission device may possibly work as a source for supplying energy that promotes the growth to the abnormal discharge.

When the above abnormal discharge takes place, not only the display quality is extremely impaired, but also the anode electrode 34 and the field emission device are damaged. That is, when the above abnormal discharge takes place, the potential in the focus electrode 215 comes close to the potential in the anode electrode 34, and the potential in the focus-electrode control circuit 41 connected to the focus electrode 215 is also increased, so that the focus-electrode control circuit 41 may be damaged. Further, as a result of the fact that the potential in the focus electrode 215 comes close to the potential in the anode electrode 34, the potential in the gate electrode 13 is also increased. As a result, the potential difference between the gate electrode 13 and the electron-emitting portion 19 is increased. Therefore, excess electrons may be emitted from the electron-emitting portion 19, the electron-emitting portion 19 may be damaged, or the gate-electrode control circuit 42 connected to the gate electrode 13 may be damaged. Further, the potential in the cathode electrode 11 is increased, and as a result, the cathode-electrode control circuit 40 connected to the cathode electrode 11 may be damaged.

FIG. 31 shows an equivalent circuit when an abnormal discharge takes place between the focus electrode 215 and the anode electrode 34. In this case, the voltage ($V_A$) applied to the anode electrode 34 is 5 kV, and the voltage applied to the focus electrode 215 is 0 volt. Due to the abnormal discharge between the anode electrode 34 and the focus electrode 215, a discharge current i flows. An imaginary resistance value (r) between the anode electrode 34 and the focus electrode 215 in this case is assumed to be 10 Ω. A resistance element R provided between the focus electrode 215 and the focus-electrode control circuit 41 is assumed to have a resistance value of 1 kΩ. Further, an electrostatic capacity $C_{AF}$ based on the anode electrode 34 and the focus electrode 215 is assumed to be 60 pF. FIG. 32 shows the result of simulation of a change in potential at a point "A" in FIG. 31. As is clearly shown in FIG. 32, the potential at the point "A" (i.e., the potential in the focus electrode 215) comes to be 2.5 kV at its maximum.

For inhibiting the abnormal discharge (spark discharge), it is effective to control the emission of electrons and ions which trigger the discharge, while it is required to control the particles extremely strictly therefor. In a general production process of the cathode panels CP or the display panels using the cathode panels CP, practicing the above control involves great technical difficulties.

Therefore, it is an object of the present invention to provide a cold cathode field emission display in which an abnormal increase in potential in the focus electrode can be suppressed even when an abnormal discharge takes place.

DISCLOSURE OF THE INVENTION

The cold cathode field emission display according to a first aspect of the present invention for achieving the above object is a cold cathode field emission display comprising at least:

(A) a display panel having a cathode panel provided with a plurality of electron-emitting regions and an anode panel provided with a phosphor layer and an anode electrode, the cathode panel and the anode panel being bonded to each other in their circumferential regions, (B) a focus-electrode control circuit, (C) a resistance element, and (D) a capacitor, each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film positioned therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode being connected to a first voltage-output portion of the focus-electrode control circuit through the resistance element, and the focus electrode being further connected to a second voltage-output portion of the focus-electrode control circuit through the capacitor.

In the cold cathode field emission display according to the first aspect of the present invention, the capacitor (a capacitor part) and the resistance element may be arranged in an ineffective field which surrounds an effective field that works as an actual display portion and in which a peripheral circuit for selecting pixels is formed, or the capacitor and the resistance element may be arranged on that portion of the display panel that is outside a frame to be discussed later, or the capacitor and the resistance element may be arranged outside the display panel, or the capacitor and the resistance element may be arranged in the focus-electrode control circuit.

The cold cathode field emission display according to a second aspect of the present invention for achieving the above object is a cold cathode field emission display comprising at least:

(A) a display panel having a cathode panel provided with a plurality of electron-emitting regions and an anode panel provided with a phosphor layer and an anode electrode, the cathode panel and the anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit.

In the cold cathode field emission display according to the first or second aspect of the present invention, there may be employed a constitution in which a plurality of the first opening portions are formed through that portion of the focus electrode that is positioned in the overlap region of the cathode electrode and the gate electrode and through the insulating film positioned therebelow, and one second opening portion is communicating with one first opening portion. In other words, there may be employed a constitution in which a plurality of the focus electrodes are formed on the insulating film above the overlap region of the cathode electrode and the gate electrode, a plurality of the first opening portions are formed through the focus electrode and the insulating film above the overlap region of the cathode electrode and the gate electrode, and the second opening portion communicating with the first opening portion is formed. The above constitution will be referred to as the cold cathode field emission display according to the first-A aspect or second-A aspect of the present invention for convenience.

Alternatively, in the cold cathode field emission display according to the first or second aspect of the present invention, there may be employed a constitution in which one first opening portion is formed through that portion of the focus electrode that is positioned in the overlap region of the cathode electrode and the gate electrode and through the insulating film positioned therebelow, and a plurality of the second opening portions are communicating with the "one" first opening portion. The above constitution will be referred to as the cold cathode field emission display according to the first-B aspect or second-B aspect of the present invention for convenience. Preferably, the first opening portion is formed so as to surround a group of the cold cathode field emission devices formed in the overlap region of the cathode electrode and the gate electrode. In other words, there may be employed a constitution in which one focus electrode is formed on the insulating film so as to surround a group of the cold cathode field emission devices formed in the overlap region of the cathode electrode and the gate electrode, one first opening portion is formed through the focus electrode and the insulating film above a group of the cold cathode field emission devices formed in the overlap region of the cathode electrode and the gate electrode, and a plurality of the second opening portions communicating with the "one" first opening portion are formed.

Although differing depending upon the structure of the cold cathode field emission devices constituting the electron-emitting region, one electron-emitting portion may exist in one second opening portion and one third opening portion formed through the gate electrode and the insulating layer, or a plurality of the electron-emitting portions may exist in one second opening portion and one third opening portion formed through the gate electrode and the insulating layer, or there may be employed a constitution in which a plurality of the second opening portions are formed through the gate electrode, one third opening portion communicating with the second opening portions is formed through the insulating layer and one electron-emitting portion exists or a plurality of the electron-emitting portions exist in one third opening portion formed through the insulating layer.

In the cold cathode field emission display according to the second-B aspect of the present invention, there may be employed a constitution in which the focus electrode comprises (1) a focus-electrode main portion formed on the insulating film and (2) a stacked structure of a dielectric material layer, a counterpart electrode formed on the upper surface of the dielectric material layer and a metal layer formed on the undersurface of the dielectric material layer, and the metal layer is fixed to the focus-electrode main portion.

Alternatively, there may be employed a constitution in which the focus electrode comprises (1) a metal layer formed on the insulating film and (2) a stacked structure of a dielectric material layer, a counterpart electrode formed on the upper surface of the dielectric material layer and a focus-electrode main portion formed on the undersurface of the dielectric material layer, and the focus-electrode main portion is fixed to the metal layer.

Alternatively, in the cold cathode field emission display according to the second-B aspect of the present invention, there may be employed a constitution in which the focus electrode comprises (1) a counterpart electrode formed on the insulating film and (2) a stacked structure of a dielectric material layer, a focus-electrode main portion formed on the upper surface of the dielectric material layer and a metal layer formed on the undersurface of the dielectric material layer, and the metal layer is fixed to the counterpart electrode.

Alternatively, there may be employed a constitution in which the focus electrode comprises (1) a metal layer formed on the insulating film and (2) a stacked structure of a dielectric material layer, a focus-electrode main portion formed on the upper surface of the dielectric material layer and a counterpart electrode formed on the undersurface of the dielectric material layer, and the counterpart electrode is fixed to the metal layer.

Alternatively, in the cold cathode field emission display according to the second-B aspect of the present invention, there may be employed a constitution in which the focus electrode comprises a stacked structure of a dielectric material layer, a counterpart electrode formed on the upper surface of the dielectric material layer and a focus-electrode main portion formed on the undersurface of the dielectric material layer, and the focus-electrode main portion is fixed to the insulating film.

Alternatively, in the cold cathode field emission display according to the second-B aspect of the present invention, there may be employed a constitution in which the focus electrode comprises a dielectric material layer, a focus-electrode main portion formed on the upper surface of the dielectric material layer and a counterpart electrode formed on the undersurface of the dielectric material layer, and the counterpart electrode is fixed to the insulating film.

Alternatively, in the cold cathode field emission display according to the second-B aspect of the present invention, there may be employed a constitution in which the focus electrode comprises a counterpart electrode formed on the insulating film, a dielectric material layer covering the top surface and side surface of the counterpart electrode, and a focus-electrode main portion formed on the dielectric material layer.

In the cold cathode field emission display according to the second aspect of the present invention, the resistance element may be arranged in the ineffective field which surrounds the effective field that works as an actual display portion and in which a peripheral circuit for selecting pixels is formed, or the resistance element may be arranged in that portion of the display panel that is outside a frame to be discussed later, or the resistance element may be arranged outside the display panel, or the resistance element may be arranged in the focus-electrode control circuit.

In the cold cathode field emission display according to the first aspect of the present invention, including the first-A aspect and the first-B aspect of the present invention, when the first voltage-output portion of the focus-electrode control circuit outputs a voltage $V_1$ and when the second voltage-output portion of the focus-electrode control circuit outputs a voltage $V_2$, preferably, $V_2<0$ and $|V_1|-|V_2|<0$. More specifically, the value of $|V_1|-|V_2|$ is preferably $-1\times10$ volts to $-1\times10^3$ volts, more preferably, $-5\times10$ volts to $-5\times10^2$ volts. When the capacity of the capacitor is $C_C$ and when the electrostatic capacity based on the anode electrode and the focus electrode is $C_{AF}$, preferably, $C_C>20C_{AF}$ is satisfied. Alternatively, the capacity $C_C$ of the capacitor is preferably 2 nF to 1 μF.

In the cold cathode field emission display according to the second aspect of the present invention including the second-A aspect of the present invention, and the second-B aspect including the above various constitutions, when the first voltage-output portion of the focus-electrode control circuit outputs a voltage $V_1$ and when the second voltage-output portion of the focus-electrode control circuit outputs a voltage $V_2$, preferably, $V_2<0$ and $|V_1|-|V_2|<0$. More specifically, the value of $|V_1|-|V_2|$ is preferably $-1\times10$ volts to $-1\times10^3$ volts, more preferably, $-5\times10$ volts to $-5\times10^2$ volts. When the capacity of the capacitor formed by the focus-electrode main portion, the dielectric material layer and the counterpart electrode is $C_C$ and when the electrostatic capacity based on the anode electrode and the focus electrode is $C_{AF}$, preferably, $C_C>20C_{AF}$ is satisfied. Alternatively, the capacity $C_C$ of the capacitor formed by focus-electrode main portion, the dielectric material layer and the counterpart electrode is preferably 2 nF to 1 μF.

In the cold cathode field emission display according to the first and second aspects of the present invention including the first-A aspect, first-B aspect, second-A aspect and second-B aspect of the present invention (these will be sometimes generally referred to as "the present invention" hereinafter), the focus electrode as a whole has the form of one sheet covering the entire effective field. The focus-electrode control circuit may have any known circuit constitution capable of outputting a predetermined DC voltage (including 0 volt) from the first voltage-output portion and the second voltage-output portion. The capacitor and the resistance element may be also constituted of any known capacitor and any known resistance element.

In the present invention, the cold cathode field emission device (to be abbreviated as "field emission device" hereinafter) can have a structure in which the electron-emitting portion is formed on the cathode electrode positioned in the bottom portion of the third opening portion and electrons are emitted from the electron-emitting portion exposed in the bottom portion of the third opening portion. The field emission device having the above first structure includes a Spindt-type (field emission device in which a conical electron-emitting portion is formed on the cathode electrode positioned in the bottom portion of the third opening portion) and a plane-type (field emission device in which an electron-emitting portion having the form of a nearly flat surface is formed on the cathode electrode positioned in the bottom portion of the third opening portion).

Specifically, the field emission device having the first structure comprises;

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film positioned therebelow, (g) a second opening portion being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, and the electron-emitting portion being formed on the cathode electrode positioned in the bottom of the third opening portion.

Alternatively, in the present invention, the field emission device can have a structure in which that portion of the cathode electrode that is exposed in the bottom portion of the third opening portion corresponds to the electron-emitting portion and electrons are emitted from that portion of the cathode electrode that is exposed in the bottom of the third opening portion. The field emission device having the above second structure includes a flat-type field emission device that is for emitting electrons from the surface of the flat cathode electrode.

Specifically, the field emission device having the second structure comprises;

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film positioned therebelow, (g) a second opening portion being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, and the cathode electrode positioned in the bottom portion of the third opening portion corresponding to the electron-emitting portion.

In the Spindt-type field emission device, the material for constituting an electron-emitting portion may include at least one material selected from the group consisting of tungsten, a tungsten alloy, molybdenum, a molybdenum alloy, titanium, a titanium alloy, niobium, a niobium alloy, tantalum, a tantalum alloy, chromium, a chromium alloy and impurity-containing silicon (polysilicon or amorphous silicon). The electron-emitting portion of the Spindt-type field emission device can be formed by, for example, a vapor deposition method, a sputtering method and a CVD method.

In the plane-type field emission device, preferably, the electron-emitting portion is made of a material having a smaller work function Φ than a material for constituting a cathode electrode. The material for constituting an electron-emitting portion can be selected on the basis of the work function of a material for constituting a cathode electrode, a potential difference between the gate electrode and the cathode electrode, a required current density of emitted electrons, and the like. Typical examples of the material for constituting a cathode electrode of the field emission device include tungsten (Φ=4.55 eV), niobium (Φ=4.02–4.87 eV), molybdenum (Φ=4.53–4.95 eV), aluminum (Φ=4.28 eV), copper (Φ=4.6 eV), tantalum (Φ=4.3 eV), chromium (Φ=4.5 eV) and silicon (Φ=4.9 eV). The material for constituting an electron-emitting portion preferably has a smaller work function Φ than these materials, and the value of the work function thereof is preferably approximately 3 eV or smaller. Examples of such a material include carbon (Φ<1 eV), cesium (Φ=2.14 eV), $LaB_6$ (Φ=2.66–2.76 eV), BaO (Φ=1.6–2.7 eV), SrO (Φ=1.25–1.6 eV), $Y_2O_3$ (Φ=2.0 eV), CaO (Φ=1.6–1.86 eV), BaS (Φ=2.05 eV), TiN (Φ=2.92 eV) and ZrN (Φ=2.92 eV). More preferably, the electron-emitting portion is made of a material having a work function Φ of 2 eV or smaller. The material for constituting an electron-emitting portion is not necessarily required to have electric conductivity.

Otherwise, in the plane-type field emission device, the material for constituting an electron-emitting portion can be selected from materials having a secondary electron gain δ greater than the secondary electron gain δ of the electrically conductive material for constituting a cathode electrode. That is, the above material can be properly selected from metals such as silver (Ag), aluminum (Al), gold (Au), cobalt (Co), copper (Cu), molybdenum (Mo), niobium (Nb), nickel (Ni), platinum (Pt), tantalum (Ta), tungsten (W) and zirconium (Zr); semiconductors such as silicon (Si) and germanium (Ge); inorganic simple substances such as carbon and diamond; and compounds such as aluminum oxide ($Al_2O_3$) barium oxide (BaO), beryllium oxide (BeO), calcium oxide (CaO), magnesium oxide (MgO), tin oxide ($SnO_2$), barium fluoride ($BaF_2$) and calcium fluoride ($CaF_2$). The material for constituting an electron-emitting portion is not necessarily required to have electric conductivity.

In the plane-type field emission device, carbon is preferred as a material for constituting an electron-emitting portion. More specifically, diamond, graphite and a carbon-nanotube structure are preferred. When the electron-emitting portion is made of diamond, graphite or the carbon-nanotube structure, an emitted-electron current density necessary for the cold cathode field emission display can be obtained at an electric field intensity of $5\times10^7$ V/m or lower. Further, since diamond is an electric resister, emitted-electron currents obtained from the electron-emitting portions can be brought into uniform currents, and the fluctuation of luminescence efficiency can be suppressed when such field emission devices are incorporated into the display. Further, since the above materials exhibit remarkably high durability against sputtering by ions of residual gas in the cold cathode field emission display, field emission devices having a longer lifetime can be attained.

Specifically, the carbon-nanotube structure includes a carbon-nanotube and a carbon-nanofiber. More specifically, the electron-emitting portion may be constituted of a carbon-nanotube, it may be constituted of a carbon-nanofiber, or it may be constituted of a mixture of a carbon-nanotube with a carbon-nanofiber. Macroscopically, the carbon-nanotube and carbon-nanofiber may have the form of a powder or a thin film. The carbon-nanotube structure may have the form of a cone in some cases. The carbon-nanotube and carbon-nanofiber can be produced or formed by a known PVD method as an arc discharge method and a laser abrasion method; and any one of various CVD methods such as a plasma CVD method, a laser CVD method, a thermal CVD method, a gaseous phase synthetic method and a gaseous phase growth method.

The plane-type field emission device can be produced by a method in which a dispersion of a carbon-nanotube structure in a binder material is, for example, applied onto a desired region of the cathode electrode and the binder material is fired or cured. More specifically, the plane-type field emission device can be produced by a method in which the carbon-nanotube structure is dispersed in an organic binder material, such as an epoxy resin or an acrylic resin, or an inorganic binder material, such as water glass or silver paste and the like, the dispersion is, for example, applied onto a desired region of the cathode electrode, then, the solvent is removed and the binder material is fired and cured. The above method will be referred to as a "first forming method of a carbon-nanotube structure". The application method includes, for example, a screen printing method.

Alternatively, the plane-type field emission device can be produced by a method in which a dispersion of the carbon-nanotube structure in a metal compound solution is applied onto the cathode electrode and then, the metal compound is fired, whereby the carbon-nanotube structure is fixed to the surface of the cathode electrode with a matrix containing metal atoms derived from the metal compound. The above method will be referred to as a "second forming method of a carbon-nanotube structure". The matrix is preferably made of an electrically conductive metal oxide. More specifically, it is preferably made of tin oxide, indium oxide, indium-tin oxide, zinc oxide, antimony oxide or antimony-tin oxide. After the firing, there can be obtained a state where part of each carbon-nanotube structure is embedded in the matrix, or there can be obtained a state where the entire portion of each carbon-nanotube is embedded in the matrix. The matrix preferably has a volume resistivity of $1\times10^{-9}$ Ω·m to $5\times10^{-6}$ Ω·m.

The metal compound for constituting the metal compound solution includes, for example, an organometal compound, an organic acid metal compound and metal salts (for example, chloride, nitrate and acetate). The organic acid metal compound solution is, for example, a solution prepared by dissolving an organic tin compound, an organic indium compound, an organic zinc compound or an organic antimony compound in an acid (for example, hydrochloric acid, nitric acid or sulfuric acid) and diluting the resultant solution with an organic solvent (for example, toluene, butyl acetate or isopropyl alcohol). Further, the organic metal compound solution is, for example, a solution prepared by dissolving an organic tin compound, an organic indium compound, an organic zinc compound or an organic antimony compound in an organic solvent (for example, toluene, butyl acetate or isopropyl alcohol). When the amount of the solution is 100 parts by weight, the solution preferably has a composition containing 0.001 to 20 parts by weight of the carbon-nanotube structure and 0.1 to 10 parts by weight of the metal compound. The solution may contain a dispersing agent and a surfactant. From the viewpoint of increasing the thickness of the matrix, an additive such as carbon black or the like may be added to the metal compound solution. In some cases, the organic solvent may be replaced with water.

The method for applying onto the cathode electrode the metal compound solution in which the carbon-nanotube structure is dispersed includes a spray method, a spin coating method, a dipping method, a die quarter method and a screen printing method. Of these, a spray method is preferred in view of its easiness in application.

There may be employed a constitution in which the metal compound solution in which the carbon-nanotube structure is dispersed is applied onto the cathode electrode, the metal compound solution is dried to form a metal compound layer, then, an unnecessary portion of the metal compound layer on the cathode electrode is removed, and then the metal compound is fired. Alternatively, an unnecessary portion of the metal compound layer on the cathode electrode may be removed after the metal compound is fired. Alternatively, the metal compound solution may be applied only onto a desired region of the cathode electrode.

The temperature for firing the metal compound is preferably, for example, a temperature at which the metal salt is oxidized to form a metal oxide having electric conductivity, or a temperature at which the organometal compound or an organic acid metal compound is decomposed to form a matrix (for example, a metal oxide having electric conductivity) containing metal atoms derived from the organometal compound or the organic acid metal compound. For example, the above temperature is preferably at least 300° C. The upper limit of the firing temperature can be a temperature at which elements constituting the field emission device or the cathode panel do not suffer any thermal damage and the like.

In the first forming method or the second forming method of a carbon-nanotube structure, it is preferred to carry out a kind of an activation treatment (washing treatment) of the surface of the electron-emitting portion after the formation of the electron-emitting portion, since the efficiency of emission of electrons from the electron-emitting portion is further improved. The above activation treatment includes a plasma treatment in an atmosphere containing a gas such as hydrogen gas, ammonia gas, helium gas, argon gas, neon gas, methane gas, ethylene gas, acetylene gas or nitrogen gas.

In the first forming method or the second forming method of a carbon-nanotube structure, the electron-emitting portion may be formed in that portion of the cathode electrode that is positioned in the bottom portion of the third opening portion, or the electron-emitting portion may be also formed so as to extend from that portion of the cathode electrode that is positioned in the bottom portion of the third opening portion to the surface of that portion of the cathode electrode that is different from the portion of the cathode electrode in the bottom portion of the third opening portion. Further, the electron-emitting portion may be formed on the entire surface or part of the surface of that portion of the cathode electrode that is positioned in the bottom portion of the third opening portion.

In the plane-type field emission device, a convexoconcave shape may be formed in the surface of the cathode electrode. As a result, the probability that top portions of a material (specifically, for example, a carbon-nanotube structure) having the function of electron emission projected from the matrix face the anode electrode is increased, and the efficiency of electron emission can be further improved. The convexoconcave shape can be formed, for example, by dry-etching the cathode electrode, by subjecting the cathode electrode to anodic oxidation, or by a method in which spheres are sprayed on to the supporting member, the cathode electrode is formed on the spheres and then, for example, the spheres are combusted.

In the field emission device having the first structure, a resistance layer may be formed between the cathode electrode and the electron-emitting portion. Otherwise, when the surface of the cathode electrode corresponds to the electron-emitting portion, that is, in the field emission device having the second structure, the cathode electrode may have a three-layered structure constituted of an electrically conductive material layer, a resistance layer and an electron-emitting layer corresponding to the electron-emitting portion. The resistance layer can stabilize performances of the field emission device and can attain uniform electron-emitting properties. The material for constituting a resistance layer includes carbon-containing materials such as silicon carbide (SiC) and SiCN; SiN; semiconductor materials such as amorphous silicon and the like; and refractory metal oxides such as ruthenium oxide ($RuO_2$), tantalum oxide and tantalum nitride. The resistance layer can be formed by a sputtering method, a CVD method or a screen-printing method. The resistance value of the resistance layer is approximately $1\times10^5$ to $1\times10^7$ Ω, preferably several MΩ.

In the various field emission devices, the material for constituting a cathode electrode can be selected from metals such as tungsten (W), niobium (Nb), tantalum (Ta), titanium (Ti), molybdenum (Mo), chromium (Cr), aluminum (Al) and copper (Cu), gold (Au), silver (Ag) and the like; alloys and compounds containing these metal elements (for example, nitrides such as TiN and silicides such as $WSi_2$, $MoSi_2$, $TiSi_2$ and $TaSi_2$); semiconductors such as silicon (Si); carbon thin film such as diamond; and indium-tin oxide (ITO). Although not specially limited thereto, the thickness of the cathode electrode is approximately 0.05 to 0.5 μm, and preferably 0.1 to 0.3 μm.

In the various field emission devices, the material for constituting the gate electrode includes at least one metal selected from the group consisting of tungsten (W), niobium (Nb), tantalum (Ta), titanium (Ti), molybdenum (Mo), chromium (Cr), aluminum (Al), copper (Cu), gold (Au), silver (Ag), nickel (Ni), cobalt (Co), zirconium (Zr), iron (Fe), platinum (Pt) and zinc (Zn); alloys or compounds containing these metal elements (for example, nitrides such as TiN and silicides such as $WSi_2$, $MoSi_2$, $TiSi_2$ and $TaSi_2$); semiconductors such as silicon (Si); and electrically conductive metal oxides such as indium-tin oxide (ITO), indium oxide and zinc oxide.

The method for forming the cathode electrode and the gate electrode includes deposition methods such as an electron beam deposition method and a hot filament deposition method, a sputtering method, a combination of a CVD method or an ion plating method with an etching method, a screen-printing method, a plating method and a lift-off method. When a screen-printing method or a plating method is employed, the cathode electrodes in the form of a stripe can be directly formed.

The method of forming the focus electrode in the cold cathode field emission display according to the first-A aspect or second-A aspect of the present invention includes, for example, vapor deposition methods such as an electron beam vapor deposition method and a hot filament vapor deposition method, a sputtering method, a CVD method, an ion plating method, a screen printing method, a plating method and a lift-off method. Generally, patterning is not required in any case except for the formation of the first opening portion and the removal of unnecessary portions. Further, the focus electrode in the cold cathode field emission display according to the first-B aspect of the present invention can be formed by a similar method, or it can be formed by a method in which a sheet-shaped focus electrode is prepared in advance and such a sheet-shaped focus electrode is stacked on the gate electrode and the insulating layer. Further, the focus electrode in the cold cathode field emission display according to the second-B aspect of the present invention can be also formed by a similar method, or it can be formed by a method in which a sheet-shaped stacked structure is formed in advance and such a sheet-shaped stacked structure can be stacked on the insulating film or the metal layer.

The plan form of the first, second or third opening portion (form obtained by cutting the first, second or third opening portion with an imaginary plane in parallel with the surface of the supporting member) may be any form such as a circle, an oval, a rectangle, a polygon, a rounded rectangle or a rounded polygon. These opening portions can be formed, for example, by isotropic etching or by a combination of anisotropic etching and isotropic etching. In the cold cathode field emission display according to the first-B or the second-B aspect of the present invention, the first opening portion can be formed by a mechanical method (for example, punching) or a chemical method (for example, etching).

As an electrically conductive material for constituting the focus electrode, an electrically conductive material for constituting the focus-electrode main portion and a material for constituting the metal layer, for example, the materials can be selected from the above electrically conductive materials used for constituting the cathode electrode or the gate electrode, or can be also selected from other materials such as sheets and foils made of metals or alloys.

As a material for constituting the dielectric material layer, for example, the material can be selected from $SiO_2$, SiN, SiON, $Ta_2O_5$, SiC, glass and an alumina.

As a material for constituting the insulating layer and the insulating film, $SiO_2$-containing material such as $SiO_2$, BPSG, PSG, BSG, AsSG, PbSG, SiN, SiON and spin on glass (SOG), low-melting-point glass and a glass paste, SiN, an insulating resin such as polyimide and the like can be used alone or in combination. The insulating layer and the insulating film can be constituted of the same material or different materials. The insulating layer and the insulating film can be formed by a known method such as a CVD method, an application method, a sputtering method or a screen printing method.

The supporting member for constituting the cathode panel in the present invention includes a glass substrate, a glass substrate having an insulating film formed on its surface, a quartz substrate, a quartz substrate having an insulating film formed on its surface and a semiconductor substrate having an insulating film formed on its surface. From the viewpoint that the production cost is decreased, it is preferred to use a glass substrate or a glass substrate having an insulating film formed on its surface. Examples of the glass substrate include high-distortion glass, soda glass ($Na_2O.CaO.SiO_2$), borosilicate glass ($Na_2O.B_2O_3.SiO_2$), forsterite ($2MgO.SiO_2$) and lead glass ($Na_2O.PbO.SiO_2$). A substrate for constituting the anode panel can have the same constitution as that of the above supporting member.

In the present invention, the anode panel comprises a substrate, a phosphor layer and an anode electrode. The surface to be irradiated with electrons is constituted of the phosphor layer or the anode electrode depending upon the structure of the anode panel.

Examples of the constitution of the anode electrode and the phosphor layer include a constitution (1) in which the anode electrode is formed on the substrate and the phosphor layer is formed on the anode electrode, and a constitution (2) in which the phosphor layer is formed on the substrate and the anode electrode is formed on the phosphor layer. In the constitution (1), a so-called metal back film may be formed on the phosphor layer. In the constitution (2), a metal back layer may be formed on the anode electrode.

The material for constituting the anode electrode can be selected depending upon the constitution of the cold cathode field emission display. That is, when the cold cathode field emission display is a transmission type (the substrate corresponds to a display screen), and when the anode electrode and the phosphor layer are stacked on the substrate in this order, not only the substrate on which the anode electrode is to be formed but also the anode electrode itself is required to be transparent, and a transparent electrically conductive material such as indium-tin oxide (ITO) is used. When the cold cathode field emission display is a reflection type (the supporting member corresponds to a display screen), or when the cold cathode field emission display is a transmission type and the phosphor layer and the anode electrode are stacked on the substrate in this order (the anode electrode also works as the metal back film), ITO can be used, and besides ITO, the material for the anode electrode can be properly selected from the above materials with respect of the cathode electrode, the gate electrode or the focus electrode. More preferably, aluminum (Al) or chromium (Cr) is used for constituting the anode electrode. When the anode electrode is made of aluminum (Al) or chromium (Cr), for example, the specific thickness of the anode electrode is $3\times10^{-8}$ m (30 nm) to $1.5\times10^{-7}$ m (150 nm), preferably $5\times10^{-8}$ m (50 nm) to $1\times10^{-7}$ m (100 nm). The anode electrode can be formed by a vapor deposition method or a sputtering method.

The phosphor material for constituting the phosphor layer can be selected from a fast-electron-excitation type phosphor material or a slow-electron-excitation type phosphor material. When the cold cathode field emission display is a monochrome display, it is not required to pattern the phosphor layer. When the cold cathode field emission display is a color display, preferably, the phosphor layers corresponding to three primary colors of red (R), green (G) and blue (B) patterned in the form of stripes or dots are alternately arranged. A black matrix may be filled in a gap between one patterned phosphor layer and another phosphor layer for improving the contrast of a display screen.

Further, the anode panel is preferably provided with a plurality of separation walls for preventing the occurrence of so-called optical crosstalk (color mixing) that is caused when electrons recoiling from the phosphor layer or secondary electrons emitted from the phosphor layer enter another phosphor layer, or for preventing the collision of electrons with other phosphor layer when electrons recoiling from the phosphor layer or secondary electrons emitted from the phosphor layer enter other phosphor layer over the separation wall.

The form of the separation walls includes the form of a lattice (grilles), that is, a form in which the separation wall surrounds the phosphor layer corresponding to one pixel and having a plan form being nearly rectangular (or dot-shaped), and a stripe or band-like form that extends in parallel with opposite two sides of a rectangular or stripe-shaped phosphor layer. When the separation wall(s) has(have) the form of a lattice, the separation wall may have a form in which the separation wall continuously or discontinuously surrounds four sides of one phosphor layer. When the separation wall(s) has(have) the form of a stripe, the stripe may be continuous or discontinuous. The formed separation walls may be polished to flatten the top surface of each separation wall.

For improving the contrast of display images, preferably, a black matrix that absorbs light from the phosphor layer is formed between one phosphor layer and another adjacent phosphor layer and between the separation wall and the substrate. As a material for constituting the black matrix, it is preferred to select a material that absorbs at least 99% of light from the phosphor layer. The above material includes carbon, a thin metal film (made, for example, of chromium, nickel, aluminum, molybdenum and an alloy of these), a metal oxide (for example, chromium oxide), metal nitride (for example, chromium nitride), a heat-resistant organic resin, glass paste, and glass paste containing a black pigment or electrically conductive particles of silver or the like. Specific examples thereof include a photosensitive polyimide resin, chromium oxide, and a chromium oxide/chromium stacked film. Concerning the chromium oxide/chromium stacked film, the chromium film is to be in contact with the substrate.

When the cathode panel and the anode panel are bonded in their circumferential portions, the bonding may be carried out with an adhesive layer or with a frame made of an insulating rigid material such as glass or ceramic and an adhesive layer. When the frame and the adhesive layer are used in combination, the facing distance between the cathode panel and the anode panel can be adjusted to be longer by properly determining the height of the frame than that obtained when the adhesive layer alone is used. While a frit glass is generally used as a material for the adhesive layer, a so-called low-melting-point metal material having a melting point of approximately 120 to 400° C. may be used. The low-melting-point metal material includes In (indium; melting point 157° C.); an indium-gold low-melting-point alloy; tin (Sn)-containing high-temperature solders such as $Sn_{80}Ag_{20}$ (melting point 220 to 370° C.) and $Sn_{95}Cu_5$ (melting point 227 to 370° C.); lead (Pb)-containing high-temperature solders such as $Pb_{97.5}Ag_{2.5}$ (melting point 304° C.), $Pb_{94.5}Ag_{5.5}$ (melting point 304–365° C.) and $Pb_{97.5}Ag_{1.5}Sn_{1.0}$ (melting point 309° C.); zinc (Zn)-containing high-temperature solders such as $Zn_{95}Al_5$ (melting point 380° C.); tin-lead-containing standard solders such as $Sn_5Pb_{95}$ (melting point 300–314° C.) and $Sn_2Pb_{98}$ (melting point 316–322° C.); and brazing materials such as $Au_{88}Ga_{12}$ (melting point 381° C.) (all of the above parenthesized values show atomic %).

When three members of the cathode panel, the anode panel and the frame are bonded, these three members may be bonded at the same time, or one of the cathode panel and the anode panel may be bonded to the frame at a first stage, and then the other of the cathode panel and the anode panel may be bonded to the frame at a second stage. When bonding of the three members or bonding at the second stage is carried out in a high-vacuum atmosphere, a space surrounded by the cathode panel, the anode panel, the frame and the adhesive layer comes to be a vacuum space upon bonding. Otherwise, after the three members are bonded, the space surrounded by the cathode panel, the anode panel, the frame and the adhesive layer may be vacuumed to obtain a vacuum space. When the vacuuming is carried out after the bonding, the pressure in an atmosphere during the bonding may be any one of atmospheric pressure and reduced pressure, and the gas constituting the atmosphere may be ambient atmosphere or an inert gas containing nitrogen gas or a gas (for example, Ar gas) coming under the group 0 of the periodic table.

When the vacuuming is carried out after the bonding, the vacuuming can be carried out through a tip tube preconnected to the cathode panel and/or the anode panel. Typically, the tip tube is made of a glass tube and is bonded to a circumference of a through-hole formed in the ineffective field of the cathode panel and/or the anode panel (i.e., the field other than the effective field which works as a display portion) with a frit glass or the above low-melting-point metal material. After the space reaches a predetermined vacuum degree, the tip tube is sealed by thermal fusion. It is preferred to heat and then temperature-decrease the cold cathode field emission display as a whole before the sealing, since residual gas can be released into the space, and the residual gas can be removed out of the space by vacuuming.

In the present invention, the gate electrode in the form of a stripe and the cathode electrode in the form of a stripe extend in the direction in which the projection images thereof cross each other at right angles, which is preferred for the simplification of structure of the cold cathode field emission display. A plurality of the field emission devices are provided in the overlap region of projection images of the cathode electrode in the form of a stripe and the gate electrode in the form of a stripe (the overlap region being an electron-emitting region and corresponding to a region forming one pixel or one sub-pixel). Such overlap regions are arranged, generally in the form of a two-dimensional matrix, in the effective field of the cathode panel. A relatively negative voltage is applied to the cathode electrode, the focus electrode or the focus-electrode main portion, a relatively positive voltage is applied to the gate electrode, and a positive voltage higher than the voltage (to be) applied to the gate electrode is applied to the anode electrode. Electrons are emitted into the vacuum space selectively from the electron-emitting portions positioned in the electron-emitting region which is an overlap region of a row-selected cathode electrode and a column-selected gate electrode (or a column-selected cathode electrode and a row-selected gate electrode), and such electrons are drawn toward the anode electrode and collide with the phosphor layer constituting the anode panel, to excite and cause the phosphor layer to emit light.

In the present invention, the capacitor is provided between the focus electrode and the focus-electrode control circuit, or the focus electrode per se works as a capacitor. When a discharge takes place between the anode electrode and the focus electrode, therefore, a current caused by the discharge flows in the capacitor, so that an abnormal increase in potential in the focus electrode can be reliably suppressed.

BRIEF DESCRIPTION OF DRAWINGS

FIG. 12B, are schematic partial end views of the supporting member, etc., for explaining the method of manufacturing a Spindt-type cold cathode field emission device in Example 1.

FIG. 17B, are schematic partial end views of the supporting member, etc., for explaining the method of manufacturing a plane-type cold cathode field emission device in Example 2.

FIG. 20B, are schematic partial end views of the supporting member, etc., for explaining the method of manufacturing a Spindt-type cold cathode field emission device in Example 3.

BEST MODE FOR CARRYING OUT THE INVENTION

The present invention will be explained on the basis of Examples and with reference to drawings hereinafter.

EXAMPLE 1

Figure 1:
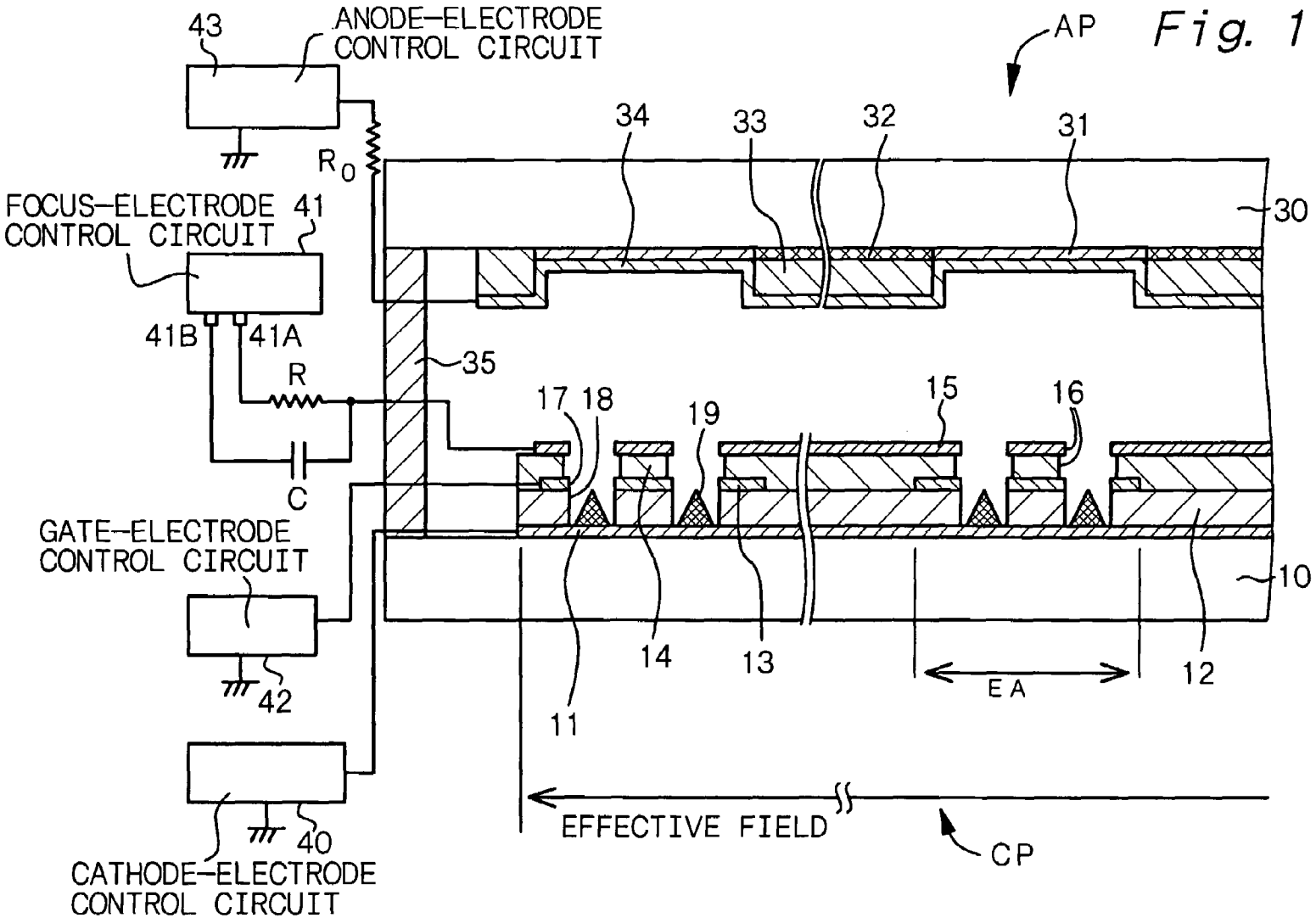
FIG. 1 is a schematic partial end view of a display panel for constituting a cold cathode field emission display in Example 1.
Figure 13A:
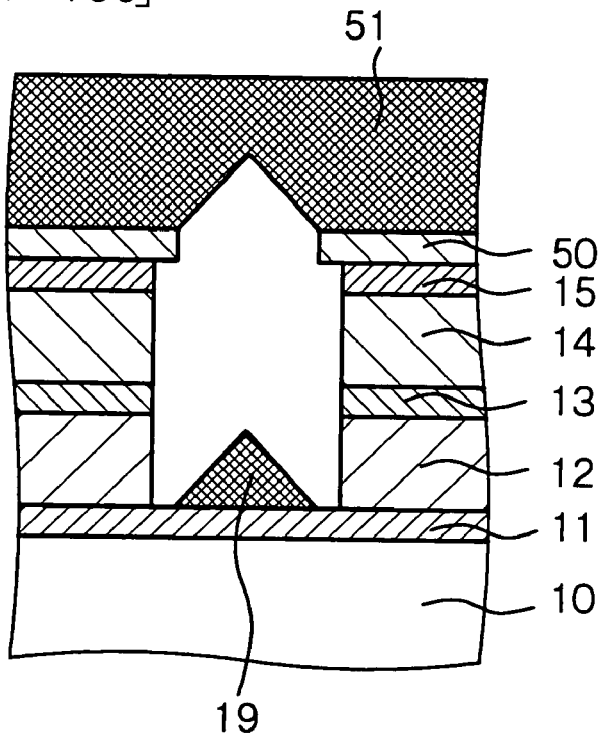
FIGS. 13A and 13B, following
Figure 13B:
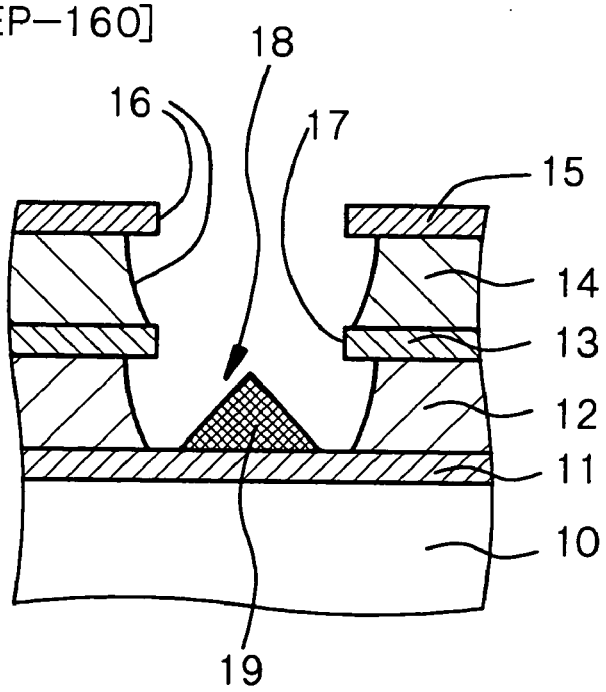
Figure 14:
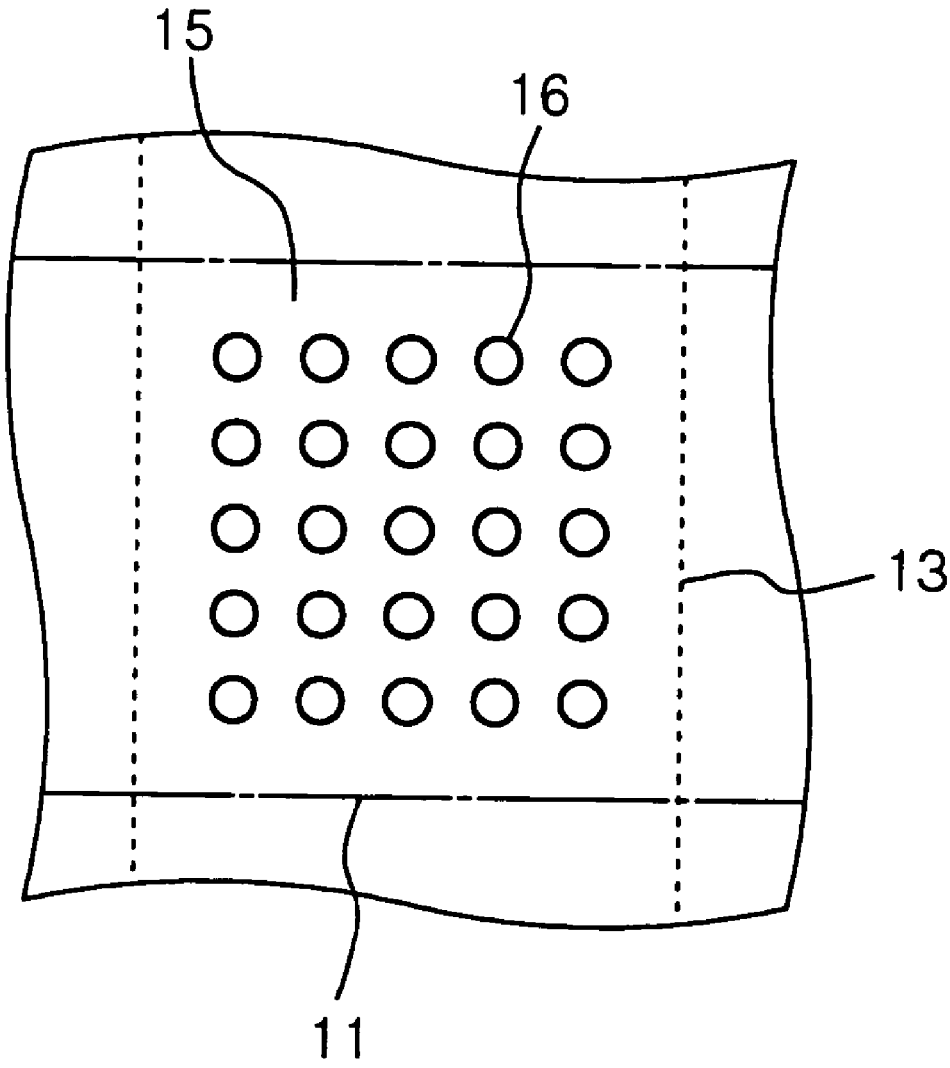
FIG. 14 is a schematic drawing of an electron-emitting region for constituting the cold cathode field emission display in Example 1 when the electron-emitting region is viewed from above.
Figure 29:
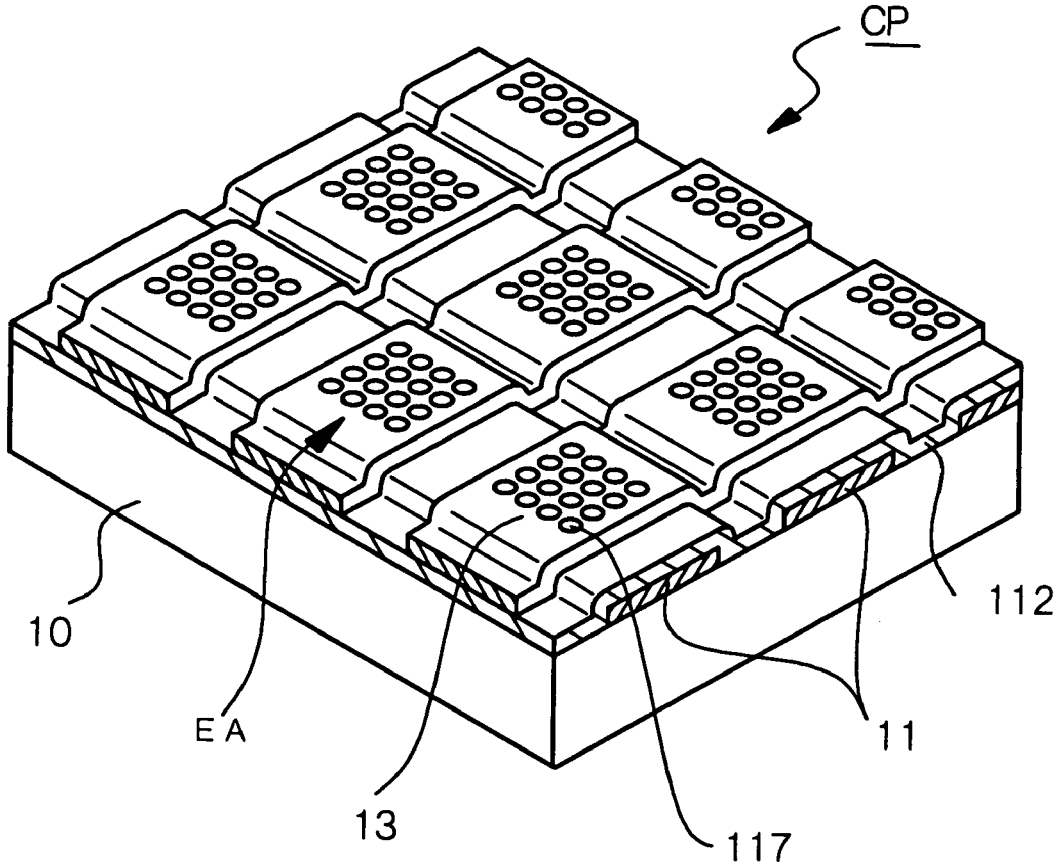
FIG. 29 is a schematic partial perspective view of a cathode panel when a cathode panel and an anode panel in a display panel of a cold cathode field emission display having a conventional cold cathode field emission device are exploded.
Figure 30:
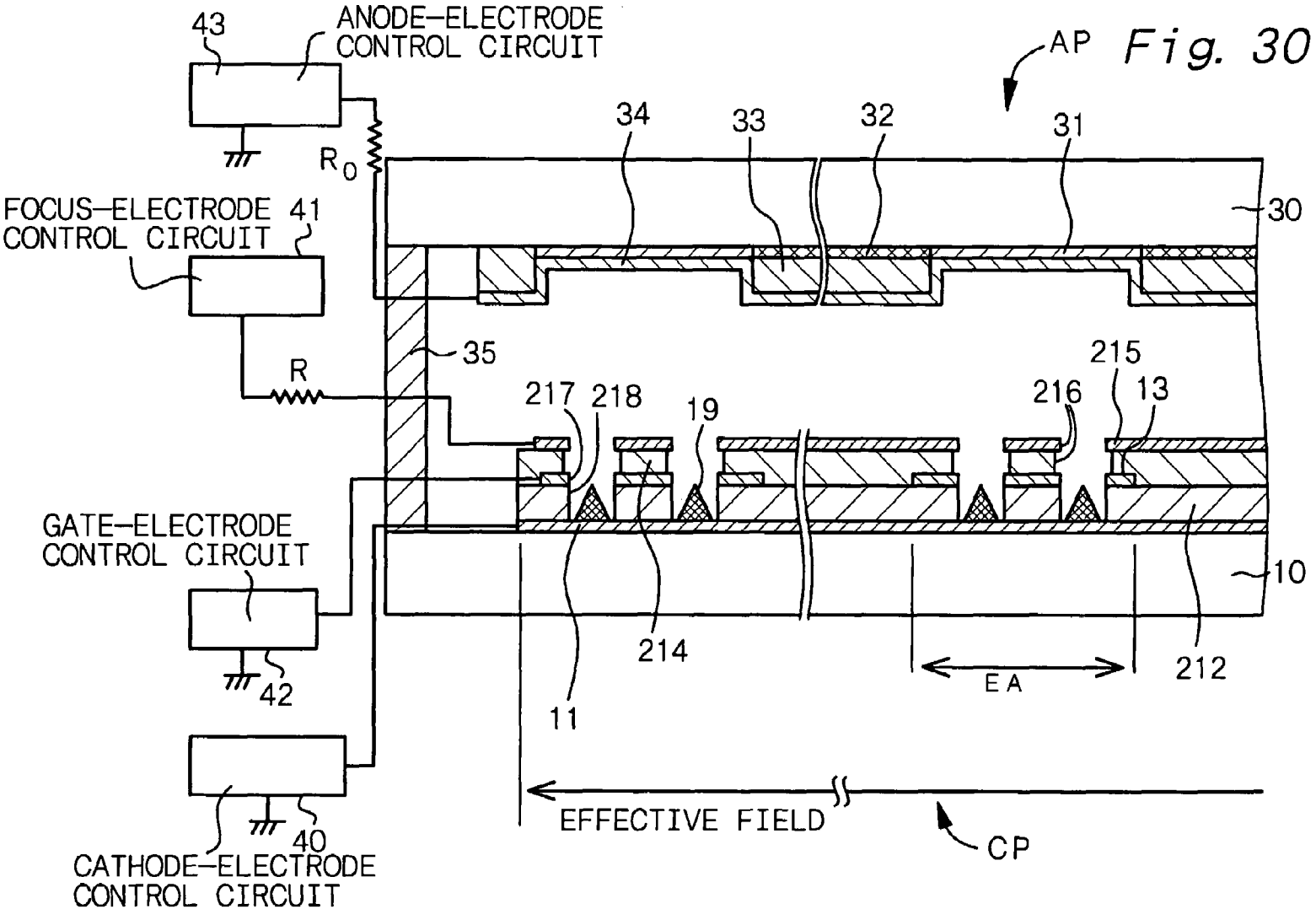
FIG. 30 is a schematic partial end view of a display panel for constituting a cold cathode field emission display having a cold cathode field emission device provided with a conventional focus electrode.
Figure 31:
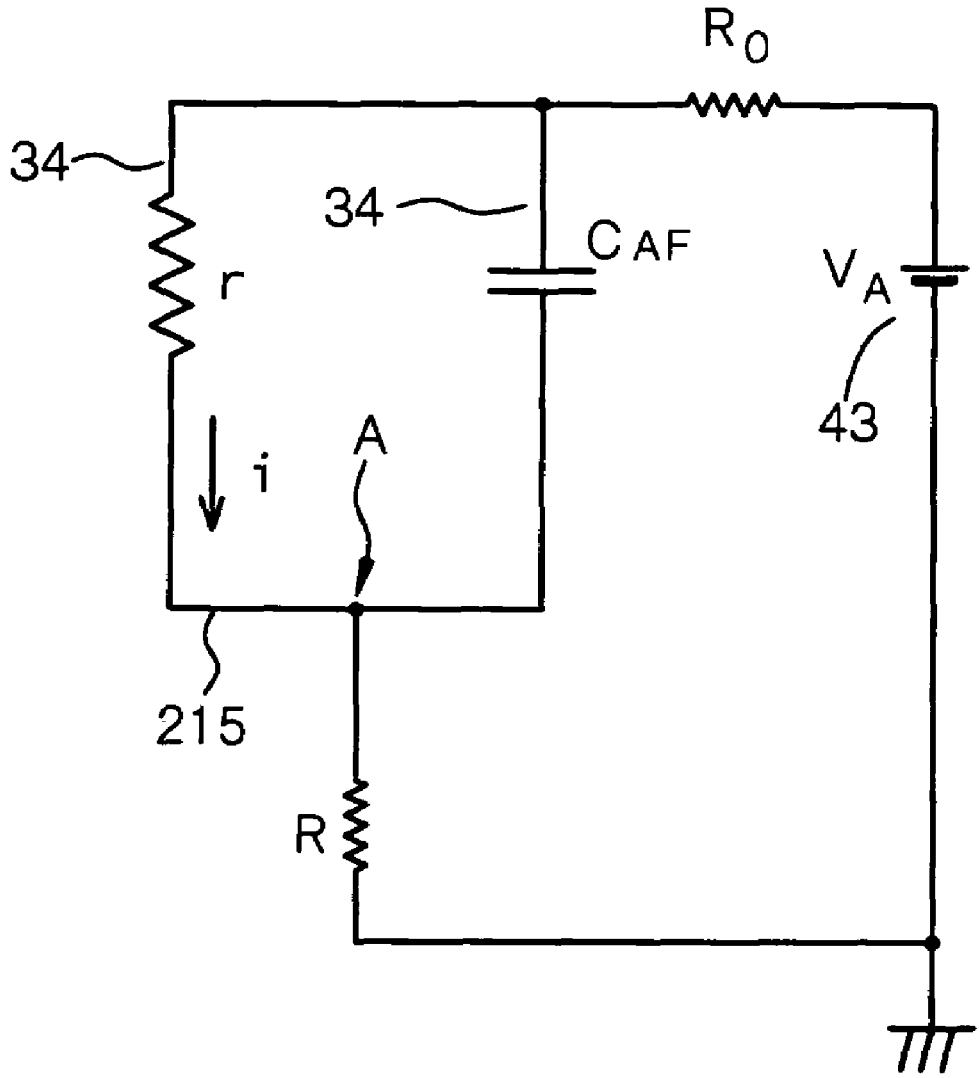
FIG. 31 is an equivalent circuit when an abnormal discharge takes place between a focus electrode and an anode electrode in a display panel having a cold cathode field emission device provided with a conventional focus electrode.
Figure 32:
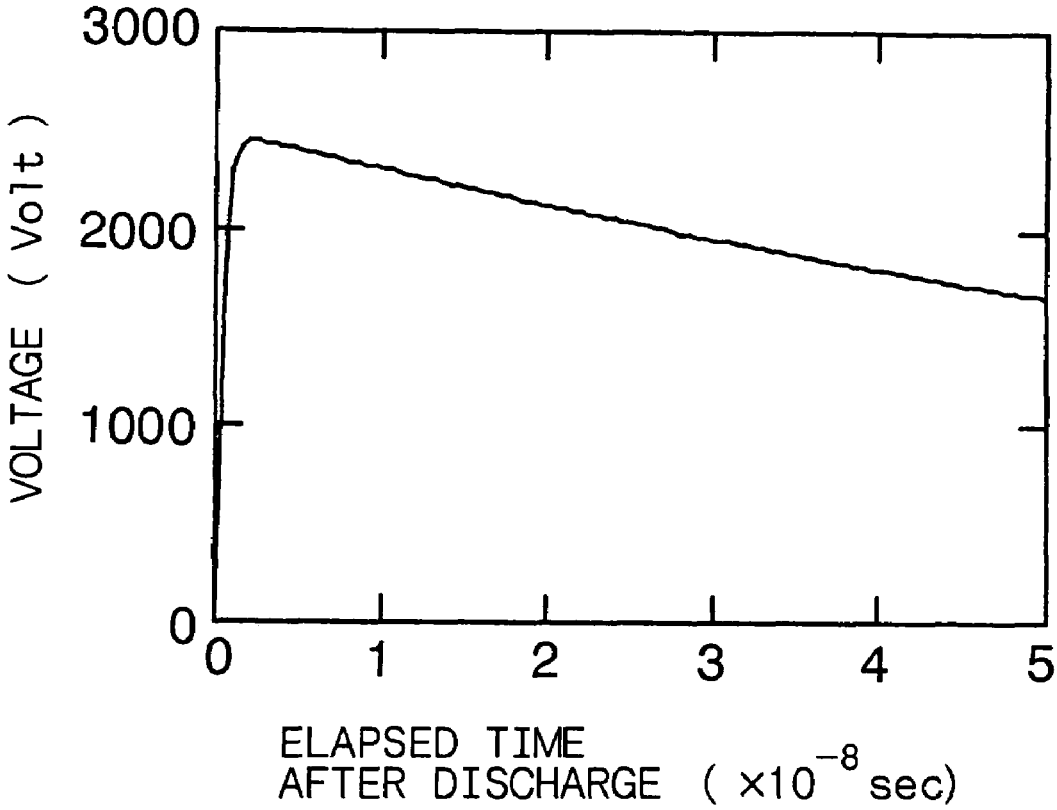
FIG. 32 is graph showing a simulation result of a change in potential at the point "A" in FIG. 31.

Example 1 is concerned with the cold cathode field emission display (to be abbreviated as "display" hereinafter) according to the first-A aspect of the present invention. FIG. 1 shows a schematic partial end view of a display panel for constituting a display having field emission devices, FIG. 13B shows a schematic partial end view of the field emission device, and FIG. 14 shows a schematic drawing of an electron-emitting region viewed from above. While many field emission devices are provided in an overlap region of a cathode electrode and a gate electrode, FIG. 13B shows one field emission device. When a cathode panel CP and an anode panel AP are exploded, the cathode panel CP has a schematic partial perspective view (however, an illustration of an insulating film and a focus electrode is omitted) as shown in FIG. 29.

The above display comprises at least;

(A) a display panel in which a cathode panel CP having a plurality of electron-emitting regions EA and an anode panel AP having a phosphor layer 31 and an anode electrode 34 are bonded to each other in their peripheral regions, (B) a focus-electrode control circuit 41, (C) a resistance element R, and (D) a capacitor C.

Each electron-emitting region EA comprises;

(a) a cathode electrode 11 being formed on a supporting member 10 and extending in a first direction (direction in parallel with the paper surface of the drawing), (b) an insulating layer 12 formed on the supporting member 10 and the cathode electrode 11, (c) a gate electrode 13 being formed on the insulating layer 12 and extending in a second direction (direction perpendicular to the paper surface of the drawing) different from the first direction, (d) an insulating film 14 formed on the insulating layer 12 and the gate electrode 13, (e) a focus electrode 15 formed on the insulating film 14, (f) a first opening portion 16 formed through that portion of the focus electrode 15 that is positioned in an overlap region of the cathode electrode 11 and the gate electrode 13 and through the insulating film 14 positioned therebelow, (g) a plurality of second opening portions 17 being formed through that portion of the gate electrode 13 that is positioned in the overlap region of the cathode electrode 11 and the gate electrode 13 and communicating with the first opening portion 16, (h) a third opening portion 18 being formed through the insulating layer 12 and communicating with the second opening portion 17, and (i) an electron-emitting portion 19 exposed in the bottom portion of the third opening portion 18.

In Example 1, the cold cathode field emission device (to be abbreviated as "field emission device" hereinafter) may have a structure in which the electron-emitting portion 19 is formed on the cathode electrode 11 positioned in the bottom portion of the third opening portion 18 and electrons are emitted from the electron-emitting portion 19 exposed in the bottom portion of the third opening portion 18. The field emission device having such a first structure includes a Spindt-type field emission device.

That is, the field emission device in Example 1 is a Spindt-type field emission device having the first structure and comprises;

(a) a cathode electrode 11 being formed on a supporting member 10 and extending in a first direction (direction in parallel with the paper surface of the drawing), (b) an insulating layer 12 formed on the supporting member 10 and the cathode electrode 11, (c) a gate electrode 13 being formed on the insulating layer 12 and extending in a second direction (direction perpendicular to the paper surface of the drawing) different from the first direction, (d) an insulating film 14 formed on the insulating layer 12 and the gate electrode 13, (e) a focus electrode 15 formed on the insulating film 14, (f) a first opening portion 16 formed through that portion of the focus electrode 15 that is positioned in an overlap region of the cathode electrode 11 and the gate electrode 13 and through the insulating film 14 positioned therebelow, (g) a second opening portion 17 being formed through that portion of the gate electrode 13 that is positioned in the overlap region of the cathode electrode 11 and the gate electrode 13 and communicating with the first opening portion 16, (h) a third opening portion 18 being formed through the insulating layer 12 and communicating with the second opening portion 17, and (i) an electron-emitting portion 19 exposed in the bottom portion of the third opening portion 18, and the electron-emitting portion 19 has the form of a cone and is formed on the cathode electrode 11 positioned in the bottom portion of the third opening portion 18.

The focus electrode 15 as a whole has the form of one sheet covering the entire effective field. A plurality of the first opening portions 16 are formed through that portion of the focus electrode 15 that is positioned in the overlap region of the cathode electrode 11 and the gate electrode 13 and through the insulating film 14 positioned therebelow, and one second opening portion 17 communicates with one first opening portion 16.

The focus electrode 15 is connected to a first voltage-output portion 41A of the focus-electrode control circuit 41 through the resistance element R, and further, the focus electrode 15 is connected to a second voltage-output portion 41B of the focus-electrode control circuit 41 through the capacitor C. The capacitor C and the resistance element R are attached, for example, to a printed circuit board provided with the focus-electrode control circuit 41, the capacitor C and the focus-electrode control circuit 41 are connected to each other through a wiring, the capacitor C and the focus electrode 15 are connected to each other through a wiring, the resistance element R and the focus-electrode control circuit 41 are connected to each other through a wiring, and the resistance element R and the focus electrode 15 are connected to each other through a wiring. A voltage $V_1$ (for example, 0 volt) is outputted from the first voltage-output portion 41A of the focus-electrode control circuit 41, and a voltage $V_2$ (for example, −100 volts) is outputted from the second voltage-output portion 41B of the focus-electrode control circuit 41.

The display panel in Example 1 comprises a cathode panel CP and an anode panel AP and has a plurality of pixels. In the cathode panel CP, a great number of the above electron-emitting regions EA provided with the above field emission devices are formed in the effective field in a manner in which they form a two-dimensional matrix. The anode panel. AP comprises a substrate 30, phosphor layers 31 (a phosphor layer 31R for emitting light in red, a phosphor layer 31G for emitting light in green and a phosphor layer 31B for emitting light in blue) formed on the substrate 30 and an anode electrode 34 that is in the form of one sheet covering the entire effective field and which is made, for example, of an aluminum thin film. A black matrix 32 is formed on the substrate 30 between the phosphor layer 31 and the phosphor layer 31, and a separation wall 33 is formed on the black matrix 32. The black matrix 32 and the separation wall 33 may be omitted. Further, when a monochromatic display is assumed, it is not required to form the phosphor layer 31 according to a predetermined pattern. Further, an anode electrode made of a transparent electrically conductive film of ITO or the like may be formed between the substrate 30 and the phosphor layer 31. Alternatively, the anode panel may comprise the anode electrode 34 made of a transparent electrically conductive film formed on the substrate 30, the phosphor layer 31 and the black matrix 32 formed on the anode electrode 34, and a light-reflecting electrically conductive film which is made of aluminum, is formed on the phosphor layer 31 and the black matrix 32 and is electrically connected to the anode electrode 34.

The display has a structure in which the substrate 30 having the anode electrode 34 and the phosphor layers 31 (31R, 31G and 31B) and the supporting member 10 having the electron-emitting regions EA are arranged in a manner in which the phosphor layers 31 and the electron-emitting regions EA are opposed and the substrate 30 and the supporting member 10 are bonded to each other in their circumferential portions. Specifically, the cathode panel CP and the anode panel AP are bonded to each other through a frame 35 in their circumferential portions. Further, the ineffective field of the cathode panel CP is provided with a through-hole (not shown) for vacuuming, and a tip tube to be used for sealing therewith after vacuuming is connected to the through-hole. The frame 35 is made of ceramic or glass and has a height, for example, of 1.0 mm. In some cases, an adhesive layer alone may be provided in place of the frame 35.

One pixel is constituted of the electron-emitting region EA and the phosphor layer 31 that is arranged in the effective field of the anode panel AP so as to face the electron-emitting region EA. In the effective filed, such pixels are arranged, for example, on the order of several hundreds of thousand to several millions.

A relatively negative voltage is applied to the cathode electrode 11 from the cathode-electrode control circuit 40, a relatively negative voltage (for example, 0 volt) is applied to the focus electrode 15 from the first voltage-output portion 41A of the focus-electrode control circuit 41, a positive voltage is applied to the gate electrode 13 from the gate-electrode control circuit 42, and a positive voltage higher than that applied to the gate electrode 13 is applied to the anode electrode 34 from the anode-electrode control circuit 43. Generally, a resistance member $R_0$ (a resistance value of 1 MΩ in an example shown) for preventing over-current and electrical discharge is provided between the anode-electrode control circuit 43 and the anode electrode 34.

Further, a voltage $V_1$ (for example, 0 volt) is applied to one end of the capacitor C (focus electrode side), and $V_2$ (for example, −100 volts) is applied to the other end of the capacitor C (the second voltage-output portion side of the focus-electrode control circuit 41) from the second voltage-output portion 41B.

When display is performed with the above display, for example, a scanning signal is inputted to the cathode electrode 11 from the cathode-electrode control circuit 40, and a video signal is inputted to the gate electrode 13 from the gate-electrode control circuit 42. Alternatively, a video signal may be inputted to the cathode electrode 11 from the cathode-electrode control circuit 40, and a scanning signal may be inputted to the gate electrode 13 from the gate-electrode control circuit 42. Due to an electric field generated when a voltage is applied between the cathode electrode 11 and the gate electrode 13, electrons are emitted from the electron-emitting portion 19 on the basis of a quantum tunnel effect, and the electrons are drawn toward the anode electrode 34 to collide with the phosphor layers 31. As a result, the phosphor layers 31 are excited, whereby a desired image can be obtained.

Figure 2:
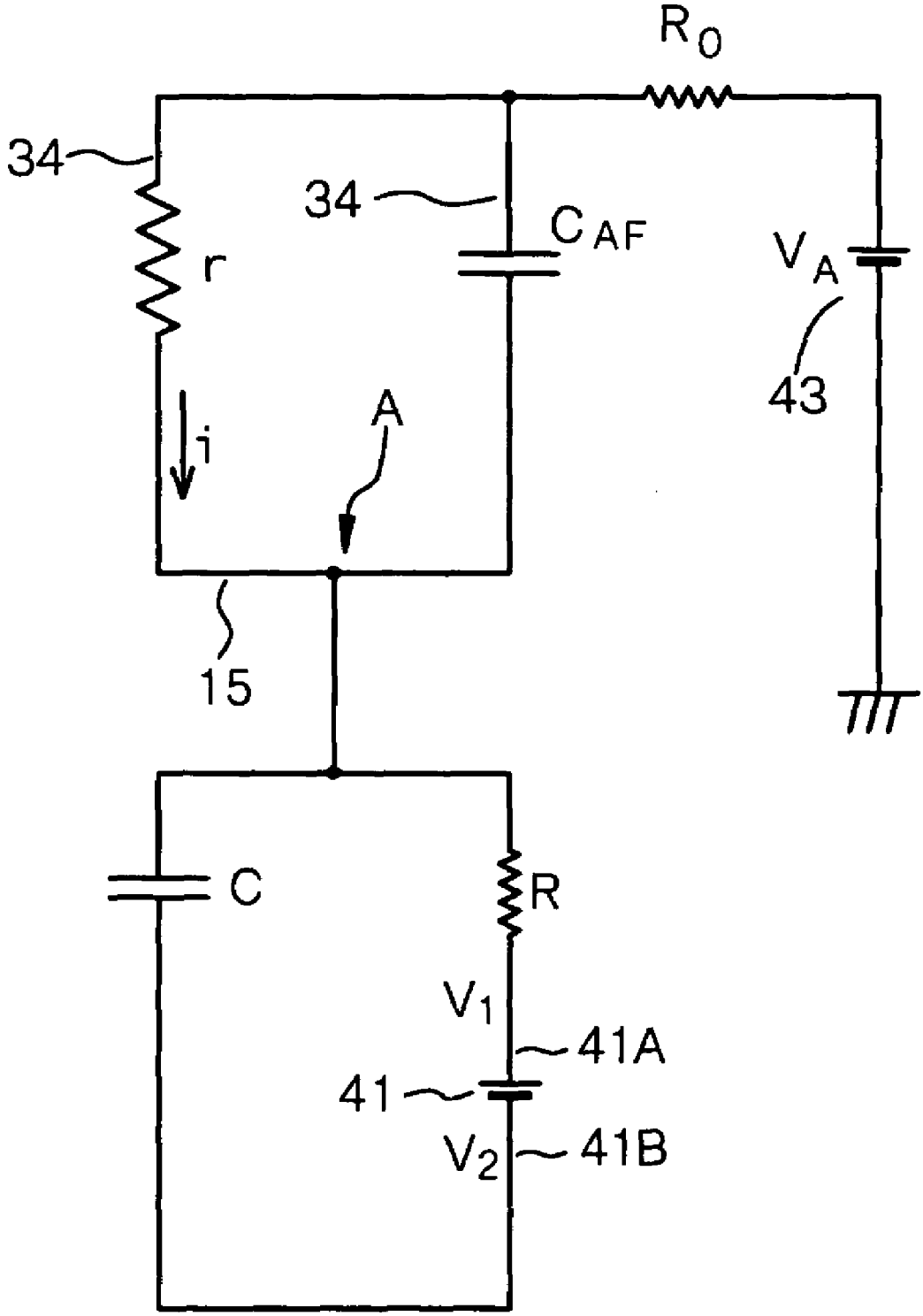
FIG. 2 is an equivalent circuit when an abnormal discharge takes place between a focus electrode and an anode electrode in the cold cathode field emission display in Example 1.

FIG. 2 shows an equivalent circuit when an abnormal discharge takes place between the focus electrode 15 and the anode electrode 34. The voltage ($V_A$) applied to the anode electrode 34 was set at 5 kilovolts, the voltage ($V_1$) applied to the focus electrode 15 was set at 0 volt, and the voltage $V_2$ was set at −100 volts. Due to an abnormal discharge between the anode electrode 34 and the focus electrode 15, a discharge current i flows, and the imaginary resistance value (r) of the anode electrode 34 and the focus electrode 15 was assumed to be 10 Ω in this case. Further, the resistance element R provided between the focus electrode 15 and the first voltage-output portion 41A of the focus-electrode control circuit 41 had a resistance value of 1 kΩ. Further, the electrostatic capacity $C_{AF}$ based on the anode electrode 34 and the focus electrode 15 was assumed to be 60 pF.

Figure 3:
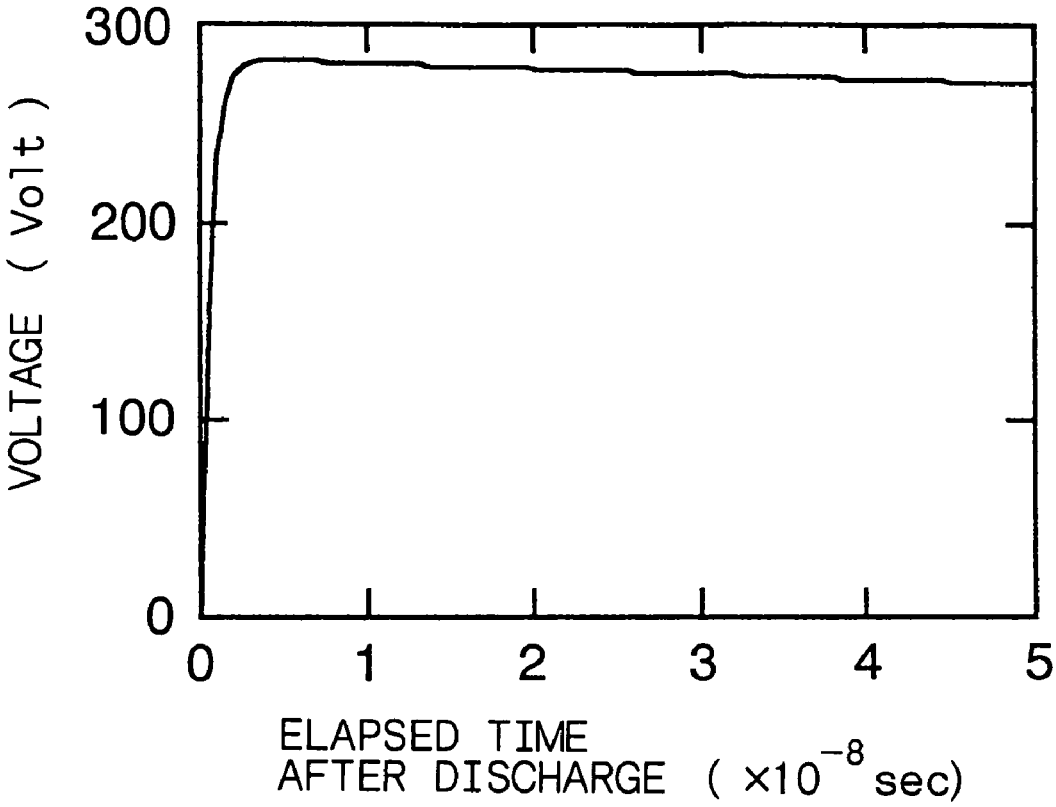
FIG. 3 is a graph showing a simulation result of a change in potential at the point "A" in FIG. 2 when the capacitor C has a capacity of 1 nF in the cold cathode field emission display in Example 1.
Figure 4:
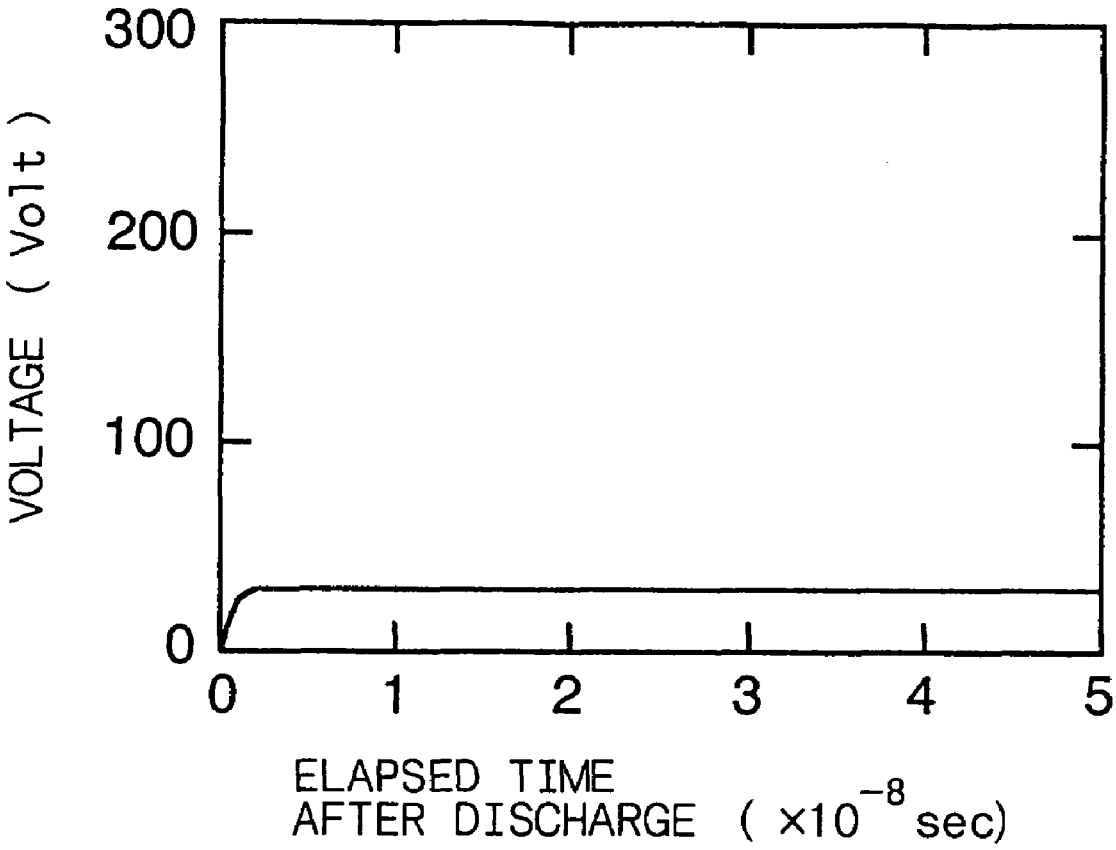
FIG. 4 is a graph showing a simulation result of a change in potential at the point "A" in FIG. 2 when the capacitor C has a capacity of 10 nF in the cold cathode field emission display in Example 1.
Figure 5:
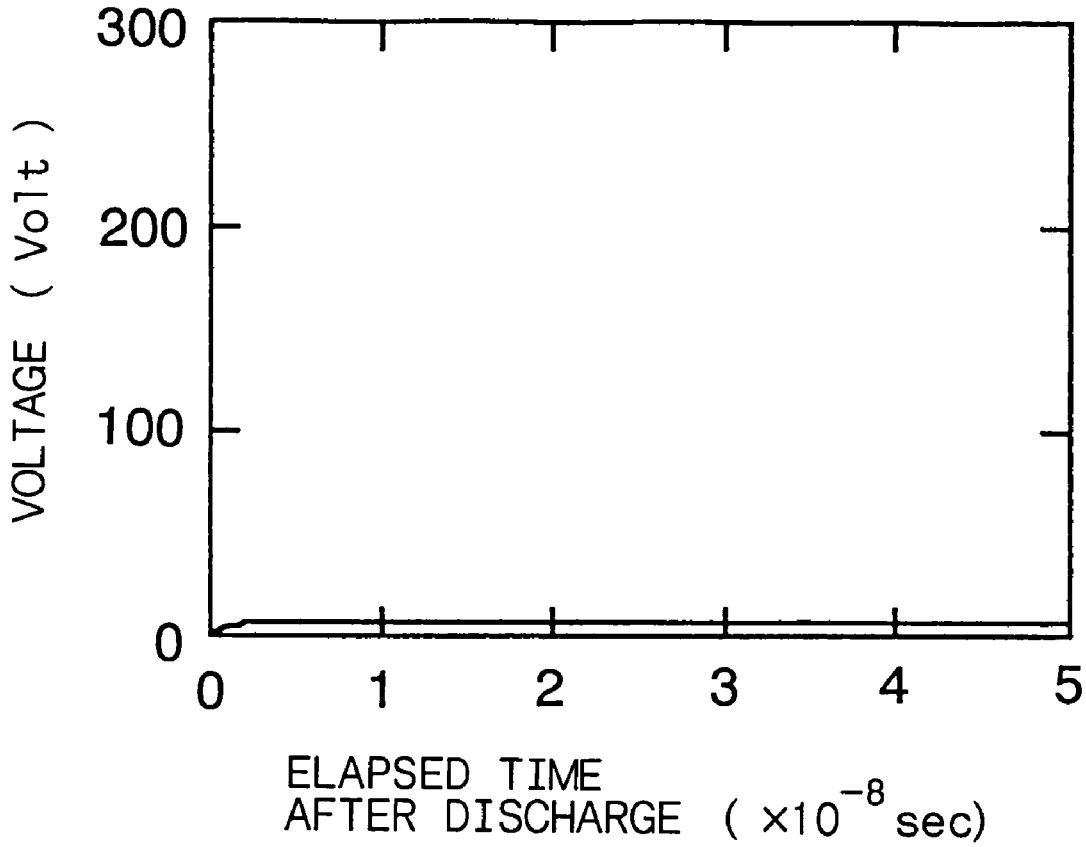
FIG. 5 is a graph showing a simulation result of a change in potential at the point "A" in FIG. 2 when the capacitor C has a capacity of 50 nF in the cold cathode field emission display in Example 1.

FIGS. 3, 4 and 5 show simulation results of a change in potential at the point "A" in FIG. 2 (i.e., potential in the focus electrode 15) when the capacitor C had a capacity of 1 nF, 10 nF and 50 nF.

Figure 6:
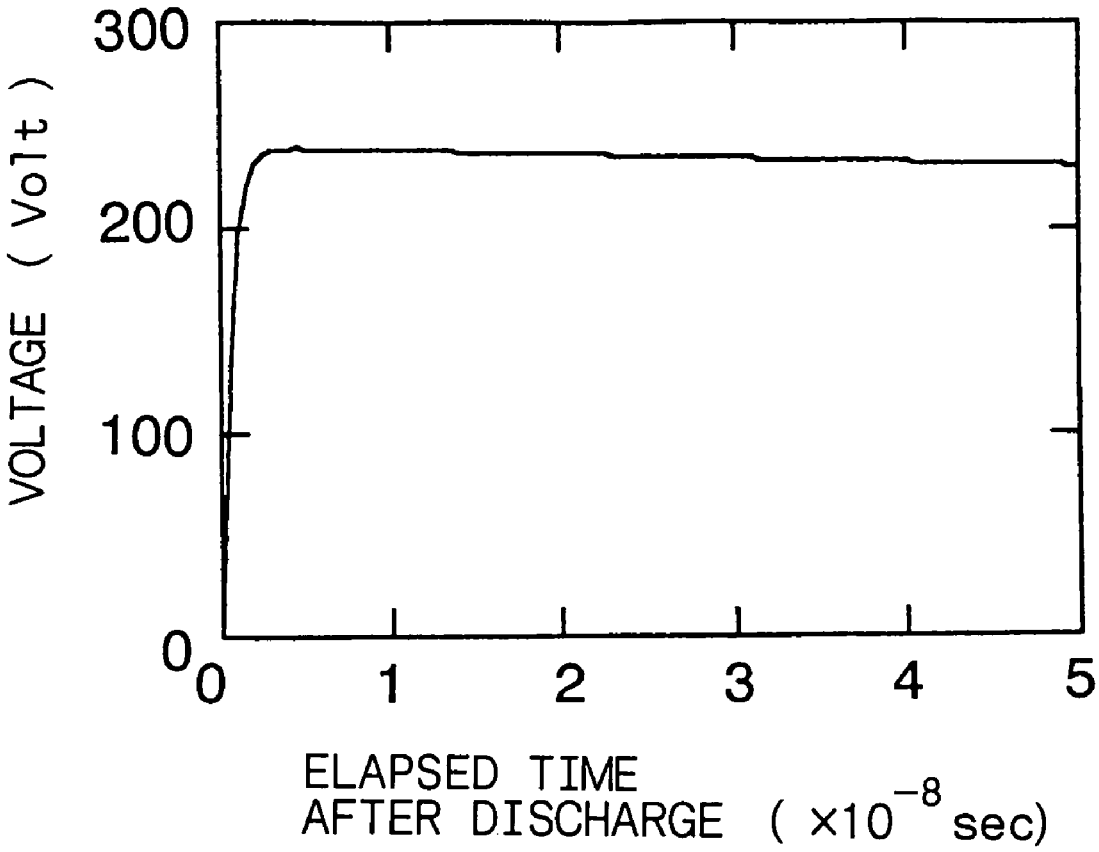
FIG. 6 is a graph showing a simulation result of a change in potential at the point "A" in FIG. 2 when the electrostatic capacity $C_{AF}$ based on the anode electrode and the focus electrode is assumed to be 60 pF and the value of the capacitor is $20C_{AF}$ in the cold cathode field emission display in Example 1.
Figure 7:
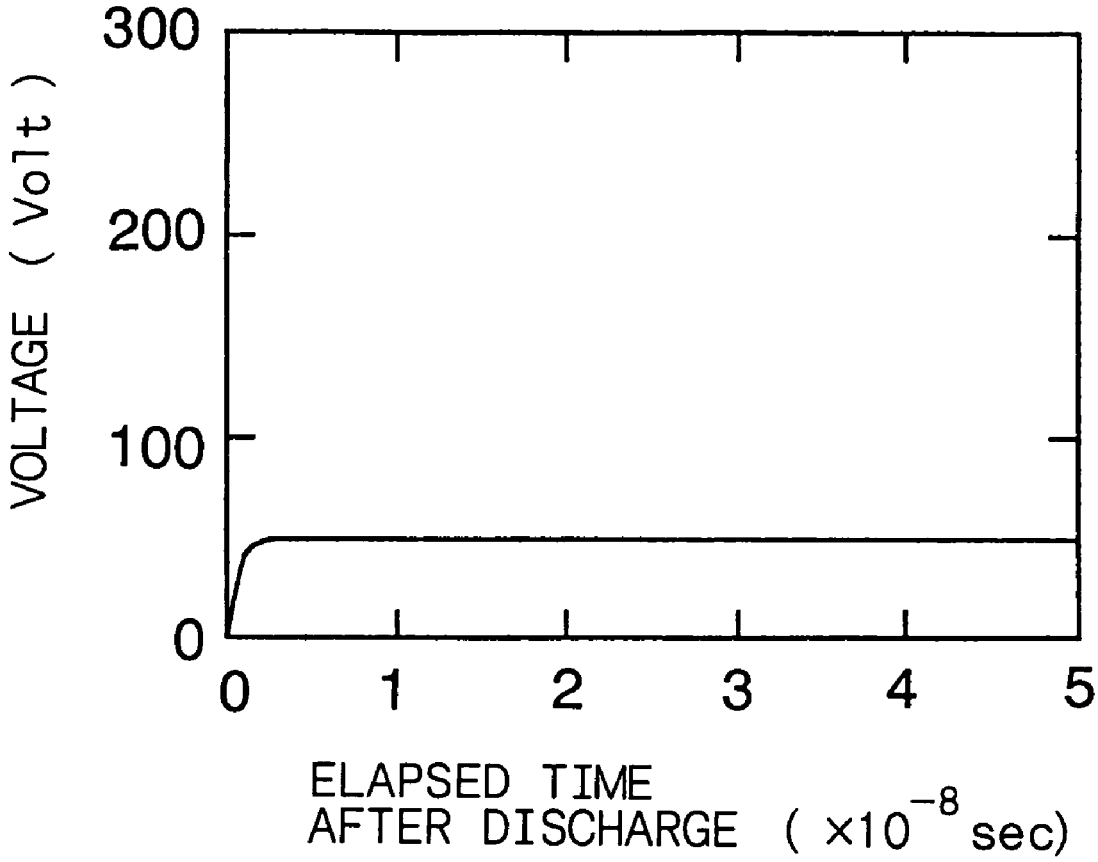
FIG. 7 is a graph showing a simulation result of a change in potential at the point "A" in FIG. 2 when the electrostatic capacity $C_{AF}$ based on the anode electrode and the focus electrode is assumed to be 60 pF and the value of the capacitor is $100C_{AF}$ in the cold cathode field emission display in Example 1.
Figure 8:
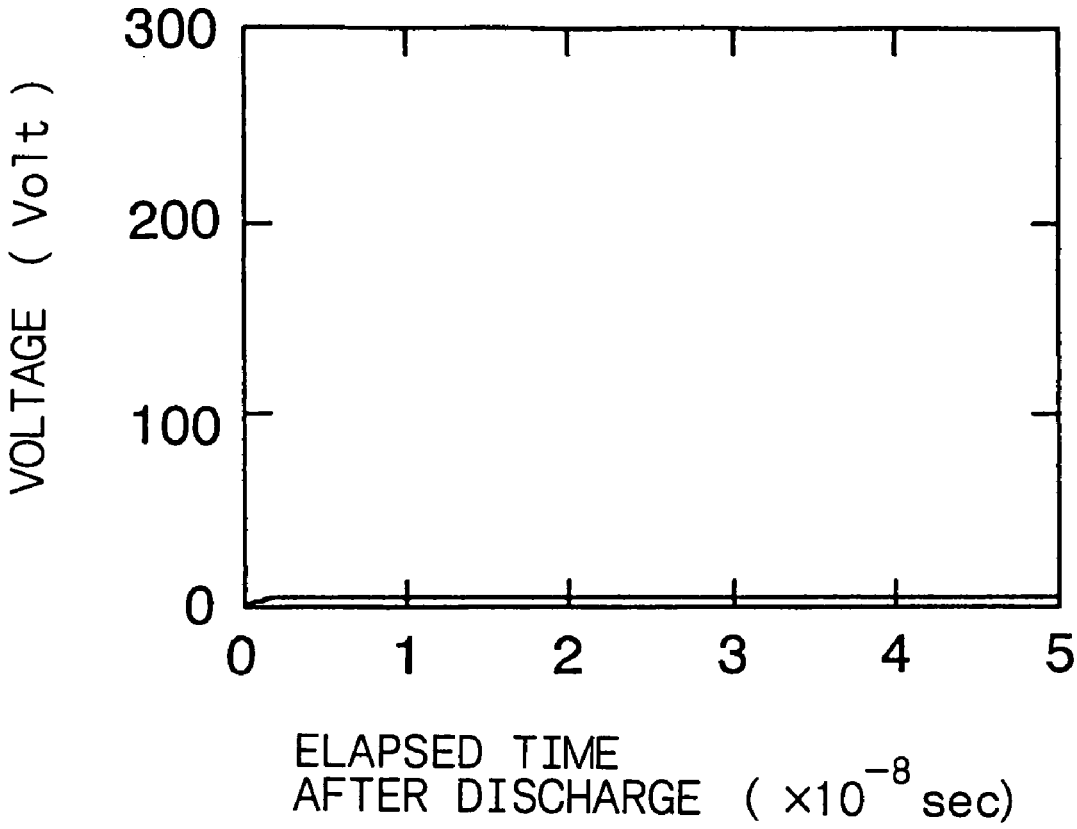
FIG. 8 is a graph showing a simulation result of a change in potential at the point "A" in FIG. 2 when the electrostatic capacity $C_{AF}$ based on the anode electrode and the focus electrode is assumed to be 60 pF and the value of the capacitor is $1000C_{AF}$ in the cold cathode field emission display in Example 1.

FIGS. 6, 7 and 8 show simulation results of a change in potential at the point "A" in FIG. 2 when the electrostatic capacity $C_{AF}$ based on the anode electrode 34 and the focus electrode 15 was assumed to be 60 pF and when the capacitor C had a value of $20C_{AF}$ (=1.2 nF), $100C_{AF}$ (=6 nF) or $1000C_{AF}$ (=60 nF).

Figure 9:
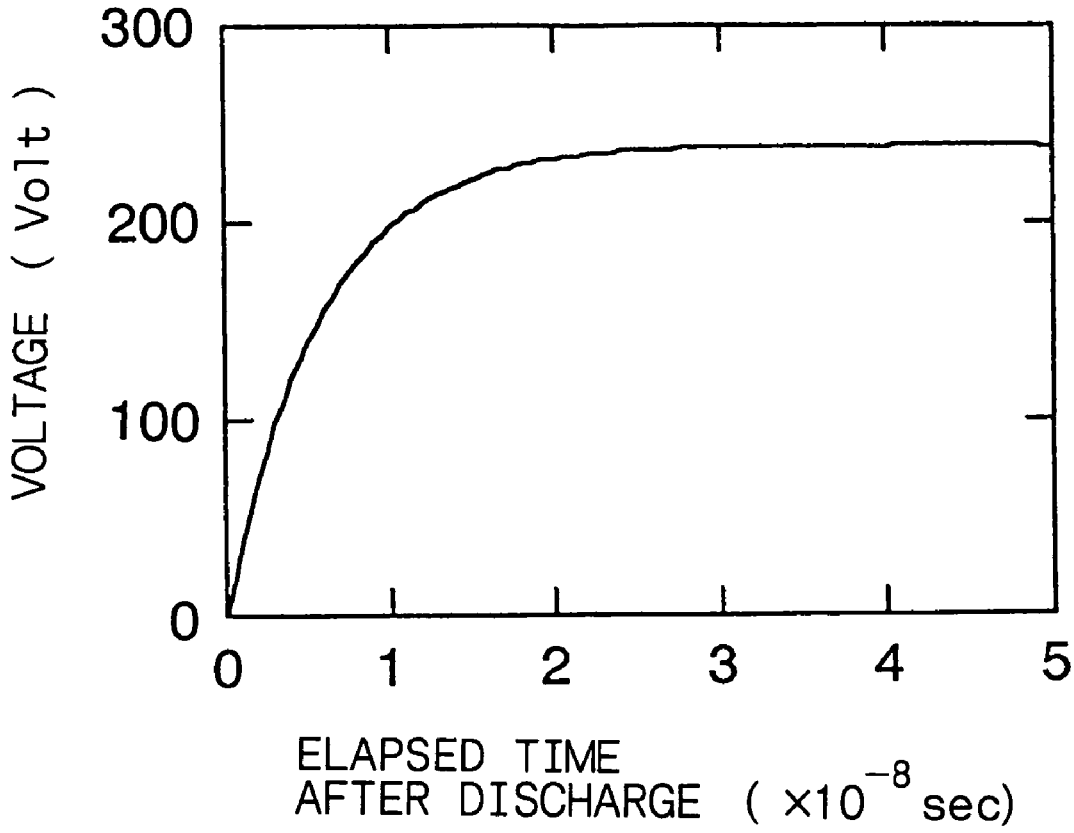
FIG. 9 is a graph showing a simulation result of a change in potential at the point "A" in FIG. 2 when the electrostatic capacity $C_{AF}$ based on the anode electrode and the focus electrode is assumed to be 600 pF and the value of the capacitor is $20C_{AF}$ in the cold cathode field emission display in Example 1.
Figure 10:
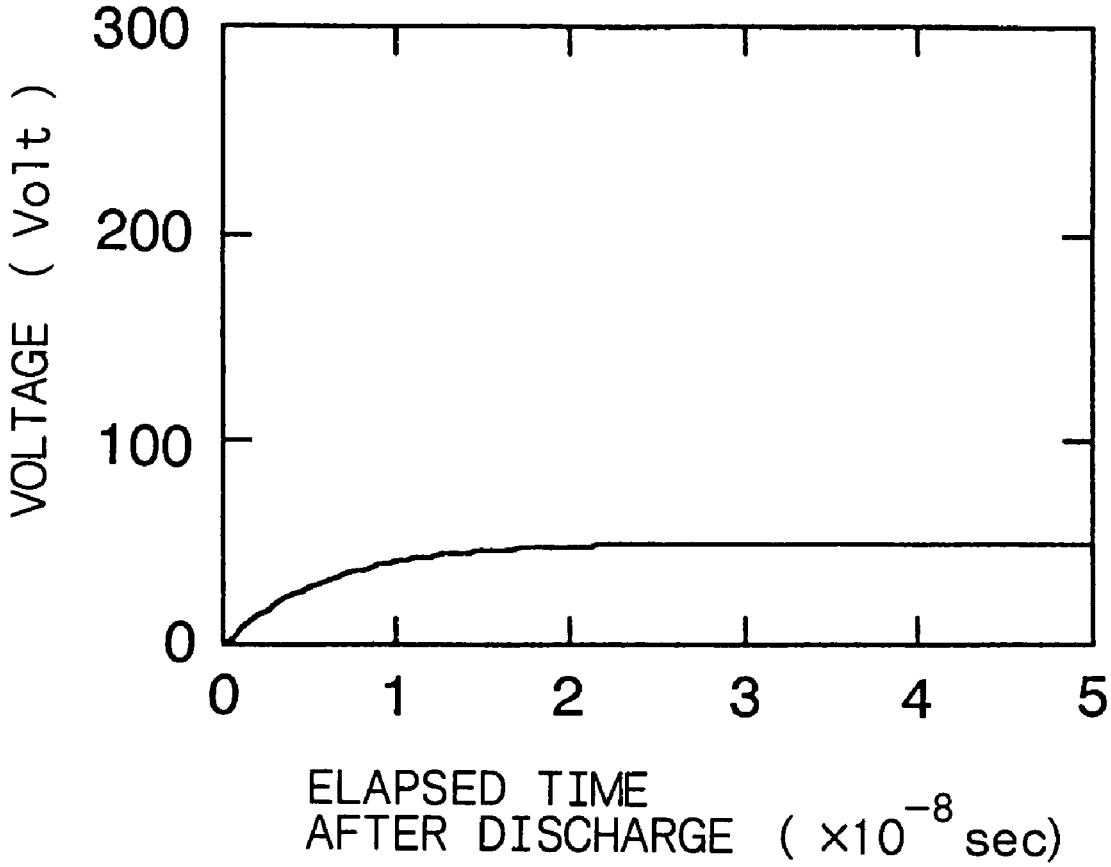
FIG. 10 is a graph showing a simulation result of a change in potential at the point "A" in FIG. 2 when the electrostatic capacity $C_{AF}$ based on the anode electrode and the focus electrode is assumed to be 600 pF and the value of the capacitor is $100C_{AF}$ in the cold cathode field emission display in Example 1.
Figure 11:
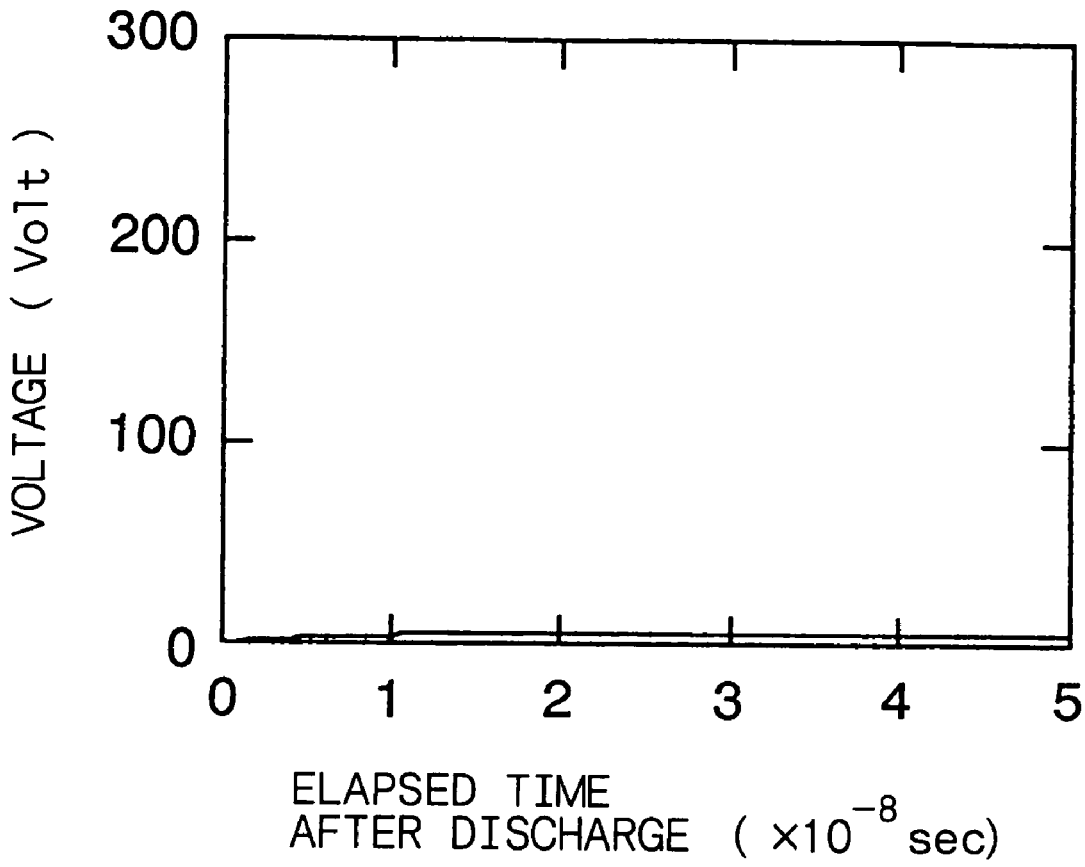
FIG. 11 is a graph showing a simulation result of a change in potential at the point "A" in FIG. 2 when the electrostatic capacity $C_{AF}$ based on the anode electrode and the focus electrode is assumed to be 600 pF and the value of the capacitor is $1000C_{AF}$ in the cold cathode field emission display in Example 1.

Further, FIGS. 9, 10 and 11 show simulation results of a change in potential at the point "A" in FIG. 2 when the electrostatic capacity $C_{AF}$ based on the anode electrode 34 and the focus electrode 15 was assumed to be 600 pF and when the capacitor C had a value of $20C_{AF}$ (=12 nF), $100C_{AF}$ (=60 nF) or $1000C_{AF}$ (=600 nF).

As is clear from FIGS. 3 to 5, the potential at the point "A" is approximately 30 volts or less when the capacitor C had a capacity of 10 nF or more. Further, it is seen that when $C_C > 20C_{AF}$ is satisfied in which $C_C$ is a capacity of the capacitor C and $C_{AF}$ is an electrostatic capacity based on the anode electrode 34 and the focus electrode 15, it is made possible to fully inhibit an increase in potential in the focus electrode 15.

Even when a discharge takes place between the anode electrode 34 and the focus electrode 15, the capacitor C can reliably serve to inhibit an increase in potential in the focus electrode 15. Further, when simulations were carried out by changing the voltage ($V_A$) applied to the anode electrode 34, similar results were obtained.

The method of manufacturing a Spindt-type field emission device having the focus electrode 15 and the method of manufacturing of a display panel in Example 1 will be explained with reference to FIGS. 12A, 12B, 13A and 13B showing schematic partial end views of the supporting member 10, etc., constituting the cathode panel and FIG. 1 showing a schematic partial end view of the display panel. In the drawings for explaining the method of manufacturing a field emission device, one electron-emitting portion alone is shown.

The Spindt-type field emission device can be obtained in principle by a method of forming the circular-cone-shaped electron-emitting portion 19 by vertical vapor deposition of a metal material. That is, vaporized particles perpendicularly enter the first opening portion 16 formed through the focus electrode 15. The amount of the vaporized particles which reach the bottom portion of the third opening portion 18 is gradually decreased by utilizing the shielding effect of an overhanging deposit formed around an opening edge portion of the first opening portion 16, so that the electron-emitting portion 19 as a circular-cone-shaped deposit is formed in a self-aligned manner. The method will be explained in which a peeling-off layer 50 is formed in advance on the focus electrode 15 for easing removal of an unnecessary overhanging deposit.

[Step-100]

A conductive material layer composed, for example, of polysilicon for a cathode electrode is formed on a supporting member 10 composed, for example, of a glass substrate by a plasma-enhanced CVD method. Then, the conductive material layer for a cathode electrode is patterned by a lithograph method and a dry etching method, to form the cathode electrode 11 having a stripe form. Thereafter, the insulating layer 12 composed of $SiO_2$ is formed on the entire surface by a CVD method.

[Step-110]

Then, the conductive material layer (for example, TiN layer) for a gate electrode is formed on the insulating layer 12 by a sputtering method. Then, the conductive material layer for a gate electrode is patterned by a lithograph method and a dry etching method to form the stripe-shaped gate electrode 13. The cathode electrode 11 in the form of a stripe extends in a direction rightward and leftward to the paper surface of the drawing and the gate electrode 13 in the form of a stripe extends in a direction perpendicular to the paper surface of the drawing.

The gate electrode 13 can be formed by a known thin film forming method such as a PVD method including a vapor deposition method and the like, a CVD method, a plating method including an electroplating method and an electroless plating method, a screen printing method, a laser abrasion method, a sol-gel method, a lift-off method and the like, or a combination of one of them with an etching method as required. For example, a stripe-shaped gate electrode can be directly formed when a screen-printing method or a plating method is employed.

Thereafter, an insulating film 14 composed of $SiO_2$ is formed on the entire surface (specifically, on the insulating layer 12 and the gate electrode 13) by a CVD method.

[Step-130]

Figure 12A:
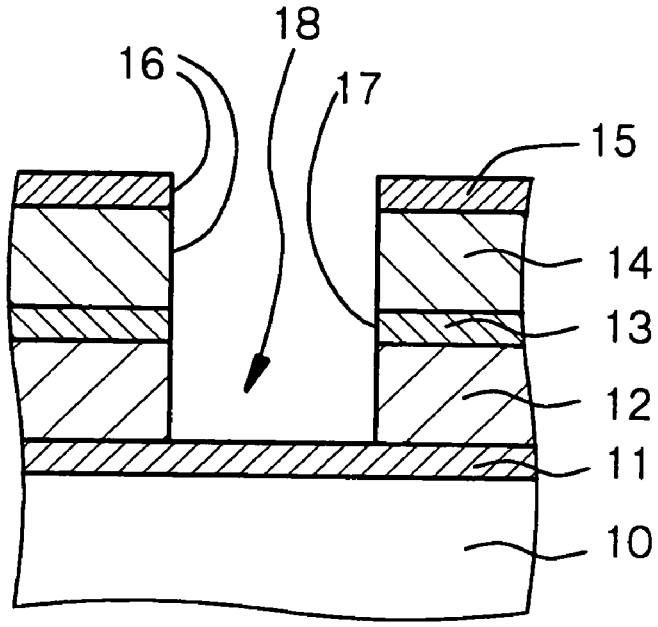
FIGS. 12A and 12B are schematic partial end views of a supporting member, etc., for explaining a method of manufacturing a Spindt-type cold cathode field emission device in Example 1.

Then, the focus electrode 15 composed of aluminum (Al) is formed on the insulating film 14 by a vapor deposition method, and the first opening portion 16 is formed through the focus electrode 15 and the insulating film 14 by a lithograph method and a dry etching method using a resist layer. Further, the second opening portion 17 communicating with the first opening portion 16 is formed through the gate electrode 13, the third opening portion 18 communicating with the second opening portion 17 is formed through the insulating layer 12 so as to expose the cathode electrode 11 in the bottom portion of the third opening portion 18, and then, the resist layer is removed. FIG. 12A schematically shows this state.

[Step-140]

Figure 12B:
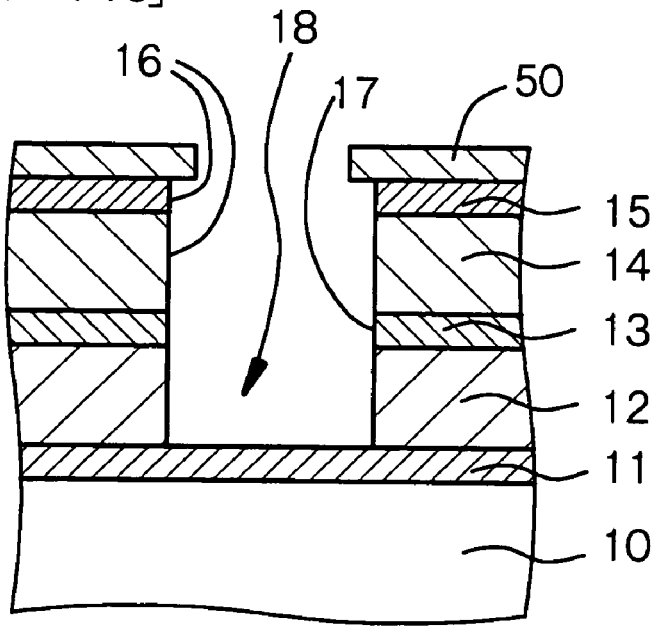

As shown in FIG. 12B, a peeling-off layer 50 is then formed on the focus electrode 15 by oblique vapor deposition of nickel (Ni) while the supporting member 10 is turned. In this case, the incidence angle of vaporized particles relative to the normal of the supporting member 10 is set at a sufficiently large angle (for example, an incidence angle of 65° to 85°) whereby the peeling-off layer 50 can be formed on the focus electrode 15 almost without depositing any nickel in the bottom portion of the third opening portion 18. The peeling-off layer 50 extends from the opening edge portion of the first opening portion 16 like eaves, whereby the diameter of the first opening portion 16 is substantially decreased.

[Step-150]

Then, an electrically conductive material such as molybdenum (Mo) is deposited on the entire surface by vertical vapor deposition (incidence angle 3° to 10°). During the above vapor deposition, as shown in FIG. 13A, as the conductive material layer 51 having an overhanging form grows on the peeling-off layer 50, the substantial diameter of the first opening portion 16 is gradually decreased, and the vaporized particles which contribute to the deposition in the bottom portion of the third opening portion 18 gradually come to be limited to particles which pass the central region of the first opening portion 16. As a result, a circular-cone-shaped deposit is formed on the bottom portion of the third opening portion 18, and the circular-cone-shaped deposit constitutes the electron-emitting portion 19.

[Step-160]

Then, the peeling-off layer 50 is peeled off from the surface of the focus electrode 15 by a lift-off method, and the conductive material layer 51 above the focus electrode 15 is selectively removed. In this manner, the cathode panel CP having a plurality of the Spindt-type field emission devices can be obtained. Then, the side wall surface of the first opening portion 16 formed through the insulating film 14 and the side wall surface of the third opening portion 18 formed through the insulating layer 12 are allowed to recede by isotropic etching, which is preferred from the viewpoint of exposing the opening end portion of the gate electrode 13. The isotropic etching can be carried out by dry etching using radicals as main etching species like chemical dry etching, or by wet etching using an etching solution. As an etching solution, for example, a mixture containing a 49% hydrofluoric acid aqueous solution and pure water in a hydrofluoric acid aqueous solution: pure water volume ratio of 1:100 can be used. In the above manner, the field emission device shown in FIG. 13B is completed. FIG. 14 shows the focus electrode 15 and the first opening portion 16 formed through the focus electrode 15. In FIG. 14, the gate electrode 13 positioned below the focus electrode 15 is indicated by a dotted line, and the cathode electrode 11 is indicated by a dot and chain line.

[Step-170]

On the other hand, the anode panel AP is prepared. Then, the display is assembled. Specifically, the anode panel AP and the cathode panel CP are arranged such that the phosphor layer 31 and the electron-emitting region EA face each other, and the anode panel AP and the cathode panel CP (more specifically, the substrate 30 and the supporting member 10) are bonded to each other in their circumferential portions through the frame 35. In the bonding, a frit glass is applied to bonding portions of the frame 35 and the anode panel AP and bonding portions of the frame 35 and the cathode panel CP. Then, the anode panel AP, the cathode panel CP and the frame 35 are attached. The frit glass is pre-calcined or pre-sintered to be dried, and then fully calcined or sintered at approximately 450° C. for 10 to 30 minutes. Then, a space surrounded by the anode panel AP, the cathode panel CP, the frame 35 and the frit glass is vacuumed through a through-hole (not shown) and a tip tube (not shown), and when the space comes to have a pressure of approximately $10^{-4}$ Pa, the tip tube is sealed by thermal fusion. In the above manner, the space surrounded by the anode panel AP, the cathode panel CP and the frame 35 can be vacuumed, whereby the display panel can be obtained. Then, wiring to external circuits is carried out to complete the so-called three-electrode-type display.

Figure 15:
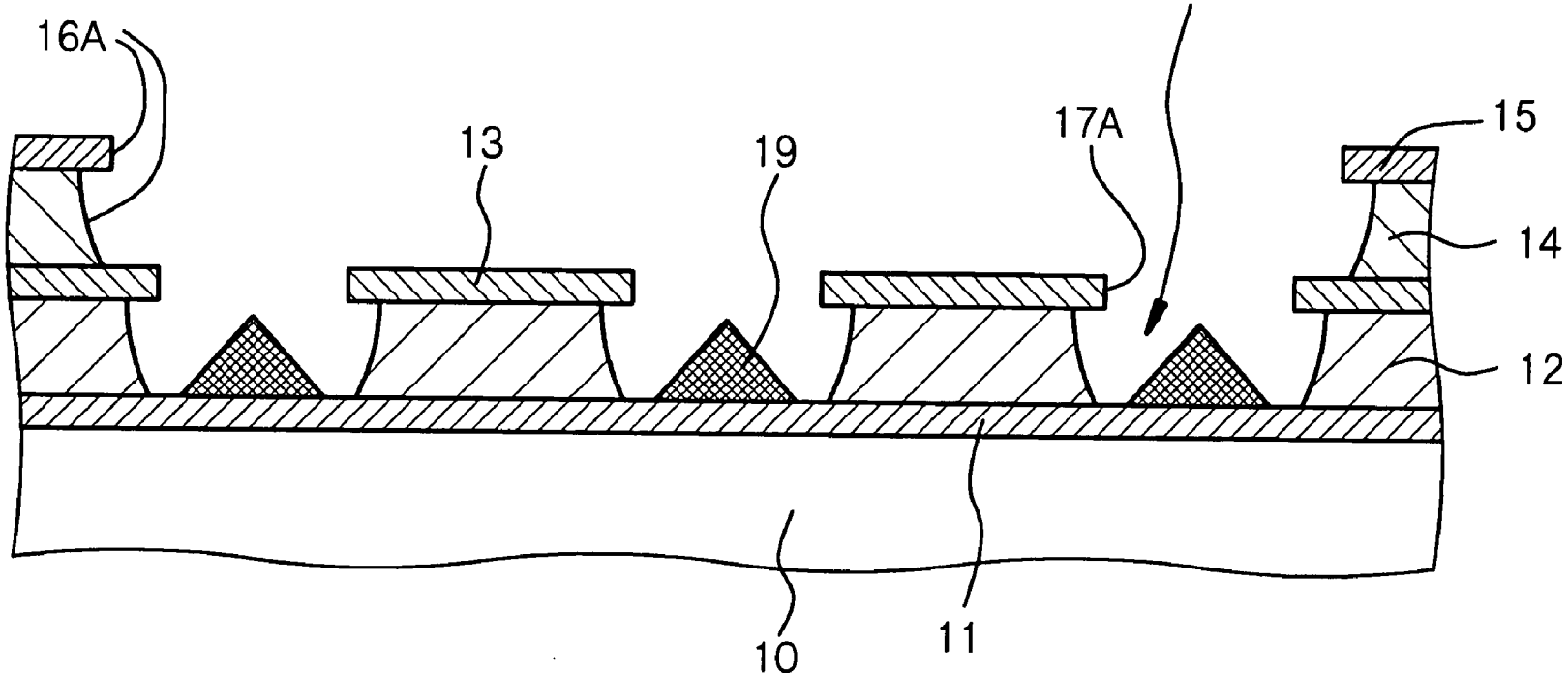
FIG. 15 is a variant of the electron-emitting region for constituting the cold cathode field emission display in Example 1.
Figure 16:
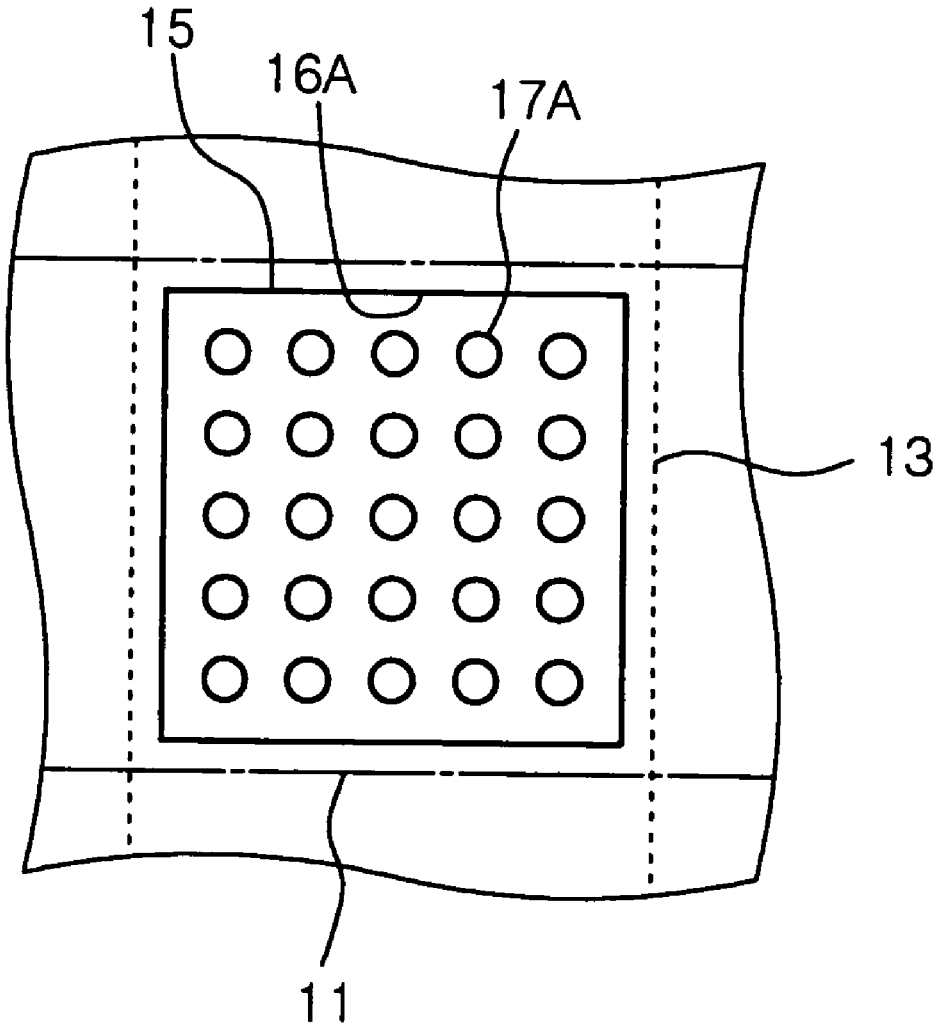
FIG. 16 is a schematic drawing of the variant of the electron-emitting region for constituting the cold cathode field emission display in Example 1 shown in FIG. 15 when the electron-emitting region is viewed from above.

In [Step-130], there may be employed a constitution in which one first opening portion 16A is formed through the focus electrode 15 and the insulating film 14 so as to surround a group of the cold cathode field emission devices formed in the overlap region of the cathode electrode 11 and the gate electrode 13, a plurality of the second opening portion 17A communicating one first opening portion 16A are formed through the gate electrode 13, and the third opening portion 18A communicating with each second opening portion 17A is formed through the insulating layer 12. In this case, in [Step-140], the peel-off layer 50 is also formed on the gate electrode 13 exposed in the bottom portion of the first opening portion 16A. In the above manner, there can be obtained a structure in which the focus electrode 15 is formed on the insulating film 14 so as to surround a group of the cold cathode field emission devices formed in the overlap region of the cathode electrode 11 and the gate electrode 13, one first opening portion 16A is formed through that portion of the focus electrode 15 that is positioned in the overlap region of the cathode electrode 11 and the gate electrode 13 and through the insulating film 14 positioned therebelow, and a plurality of the second opening portions 17A communicate with one first opening portion 16A, that is, there can be obtained the display according to the first-B aspect of the present invention. FIG. 15 shows a schematic partial end view of the above structure, and FIG. 16 shows a schematic drawing of the electron-emitting portion viewed from the above. Although FIG. 15 shows three field emission devices in the overlap region of the cathode electrode 11 and the gate electrode 13, FIG. 15 shows one embodiment as an example. Further, FIG. 16 shows the focus electrode 15 and the first opening portion 16A formed through the focus electrode 15. In FIG. 16, the gate electrode 13 positioned below the focus electrode 15 is indicated by a dotted line, the cathode electrode 11 is indicated by a dot and chain line, and the second opening portions 17A formed through the gate electrode 13 are indicated by a circular solid line.

EXAMPLE 2

Example 2 is a variant of Example 1. Example 1 used the Spindt-type as a field emission device. In Example 2, the field emission device is a plane-type (a field emission device in which an electron-emitting portion having the form of a nearly flat plane is formed on the cathode electrode positioned in the bottom portion of the third opening portion).

Figure 18A:
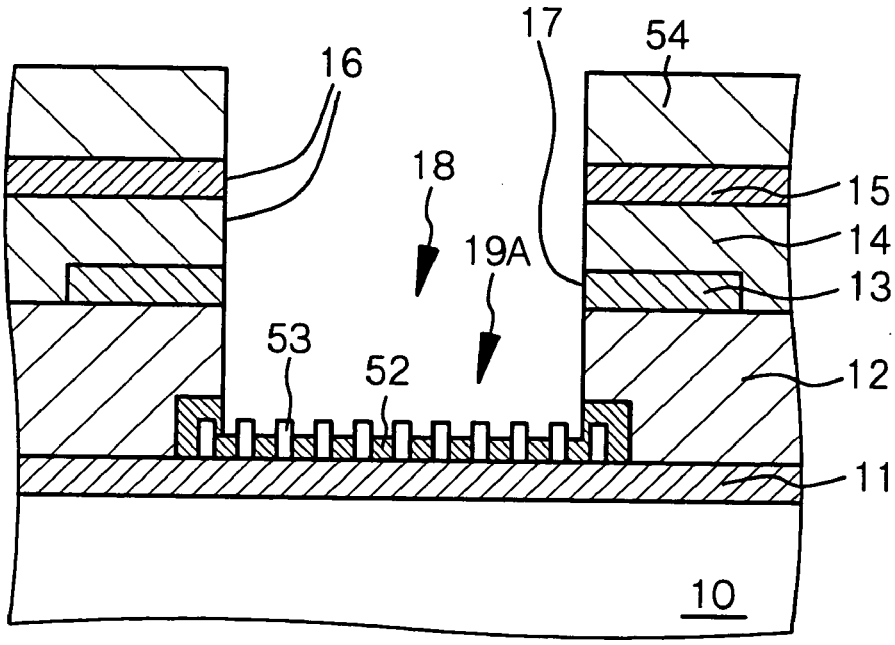
FIGS. 18A and 18B, following
Figure 18B:
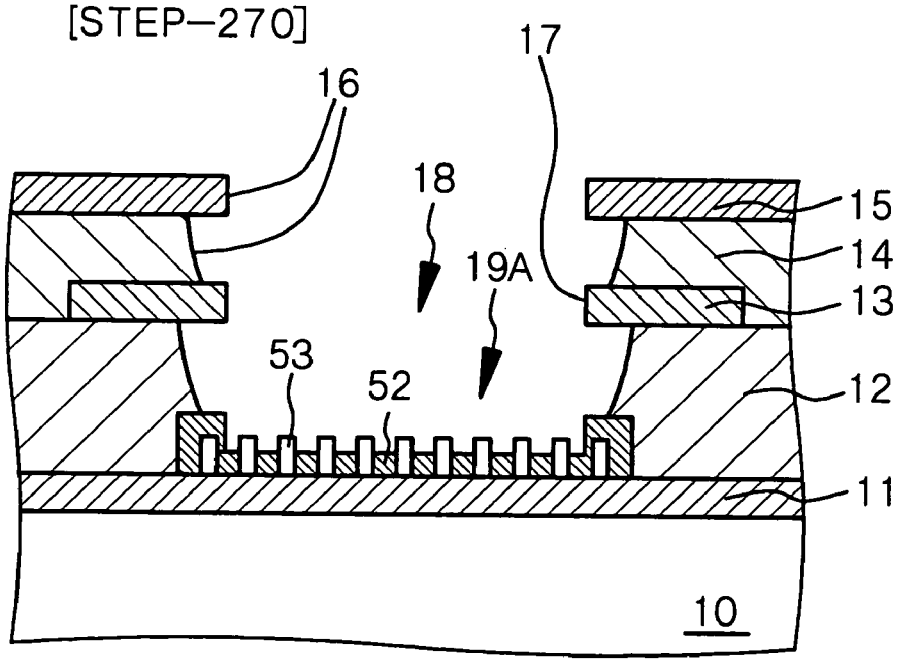
Figure 19:
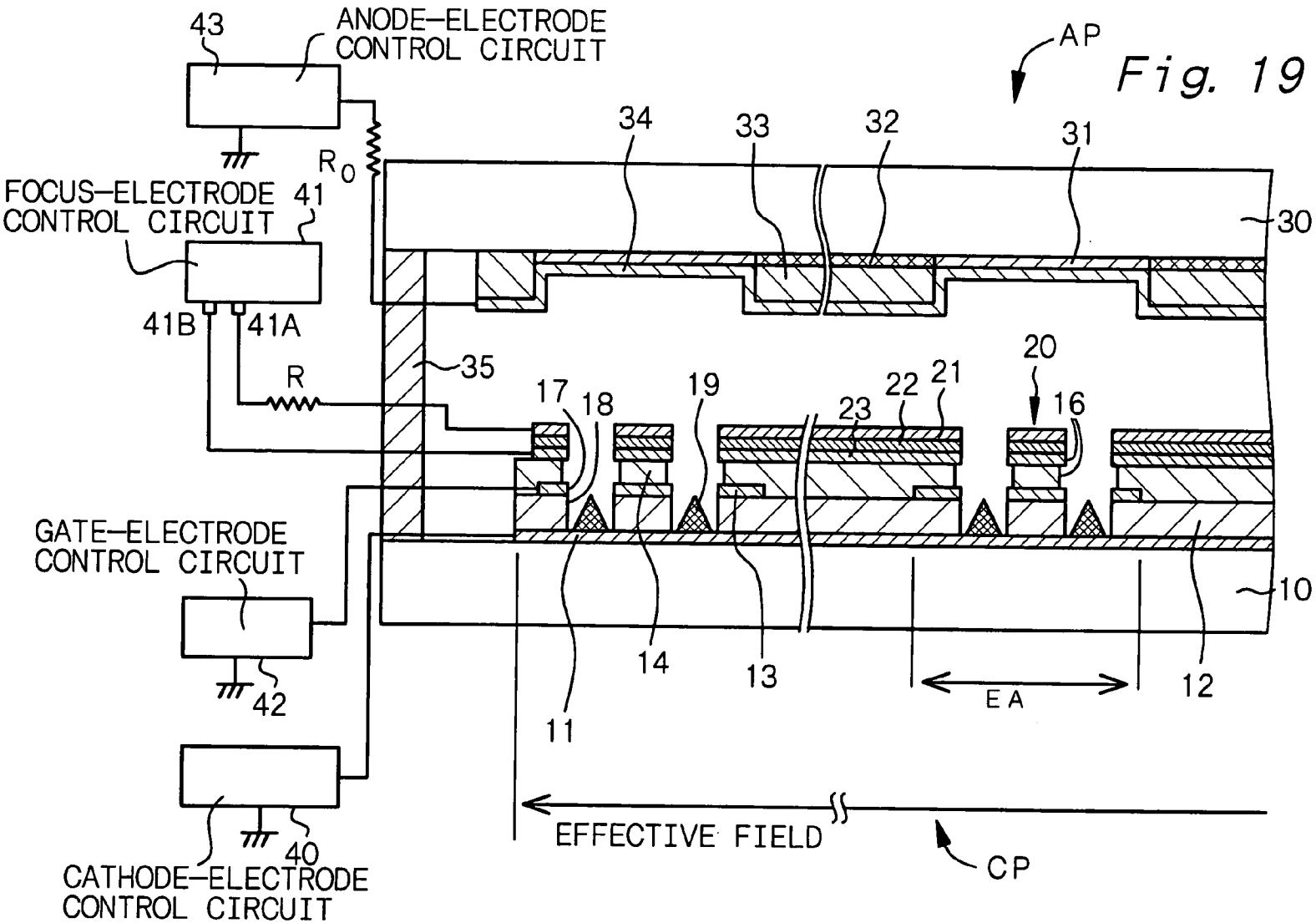
FIG. 19 is a schematic partial end view of a display panel for constituting a cold cathode field emission display in Example 3.
Figure 20A:
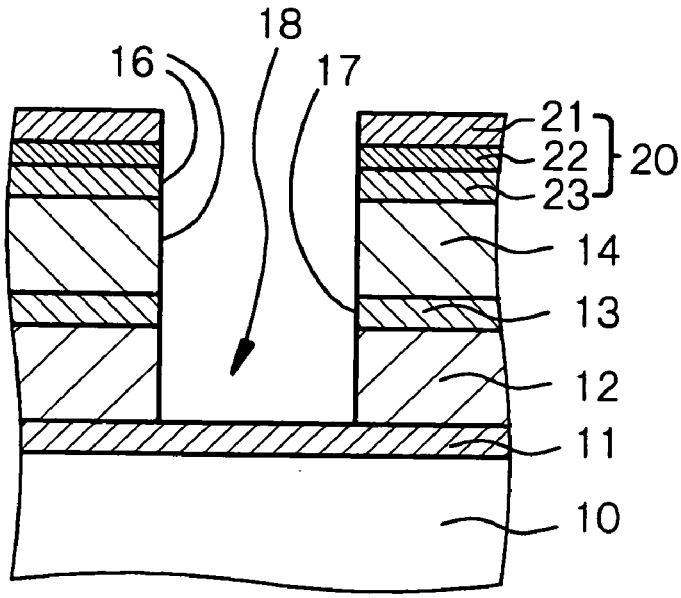
FIGS. 20A and 20B are schematic partial end views of a supporting member, etc., for explaining a method of manufacturing a Spindt-type cold cathode field emission device in Example 3.
Figure 20B:
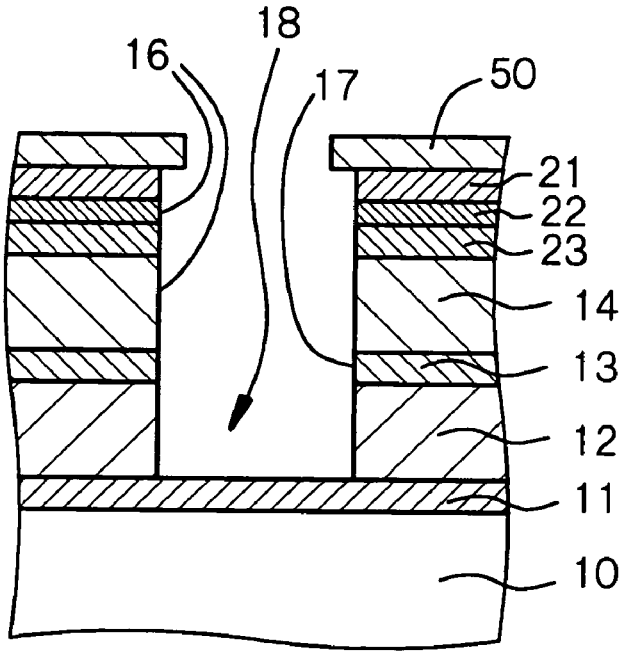
Figure 21A:
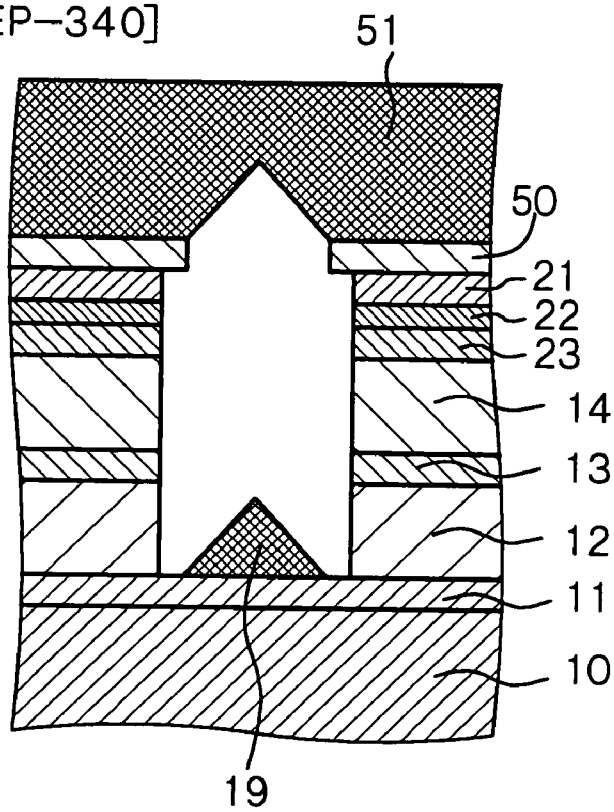
FIGS. 21A and 21B, following
Figure 21B:
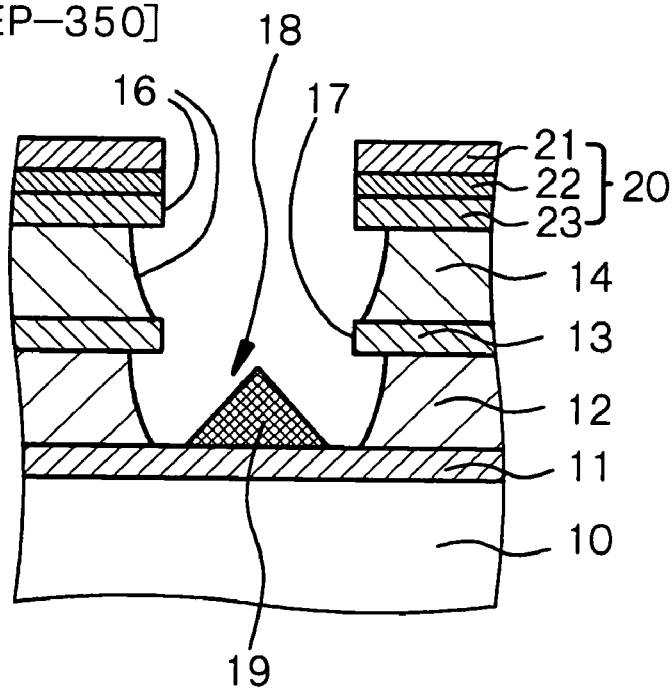
Figure 22:
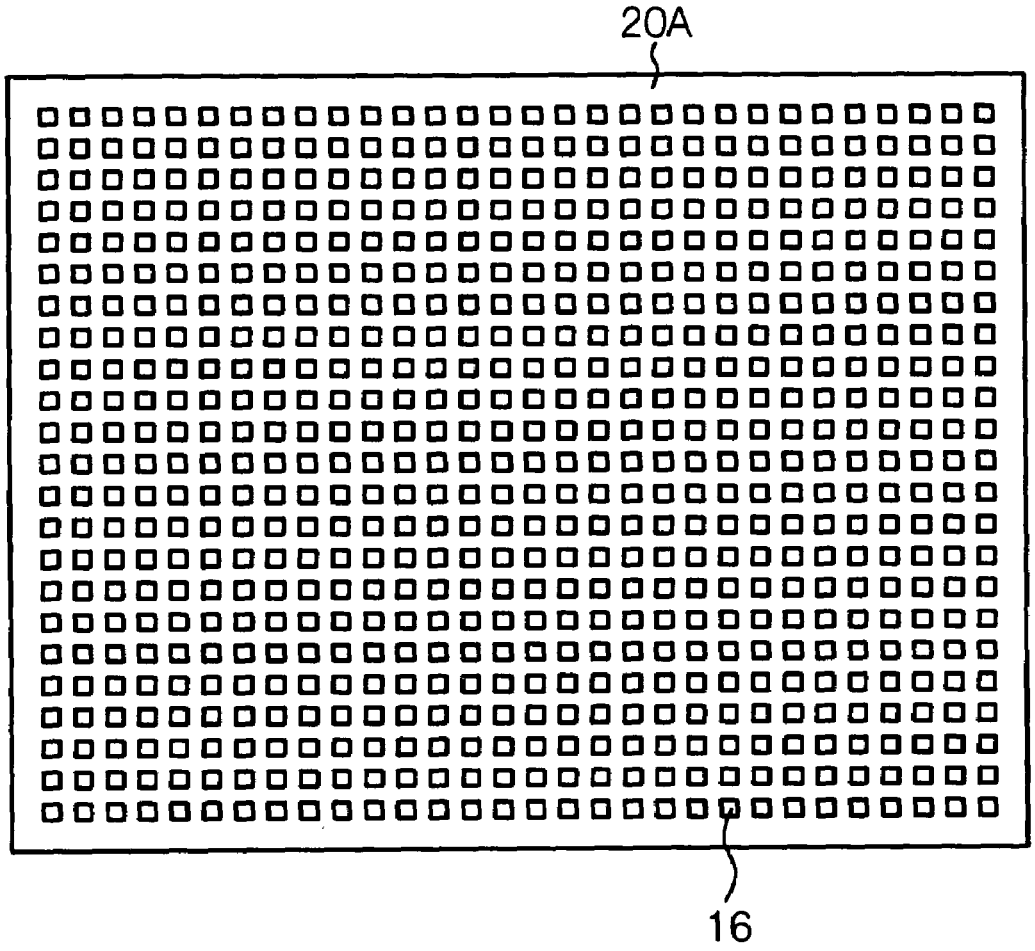
FIG. 22 is a schematic plan view of a stacked structure in Example 4.
Figure 23A:
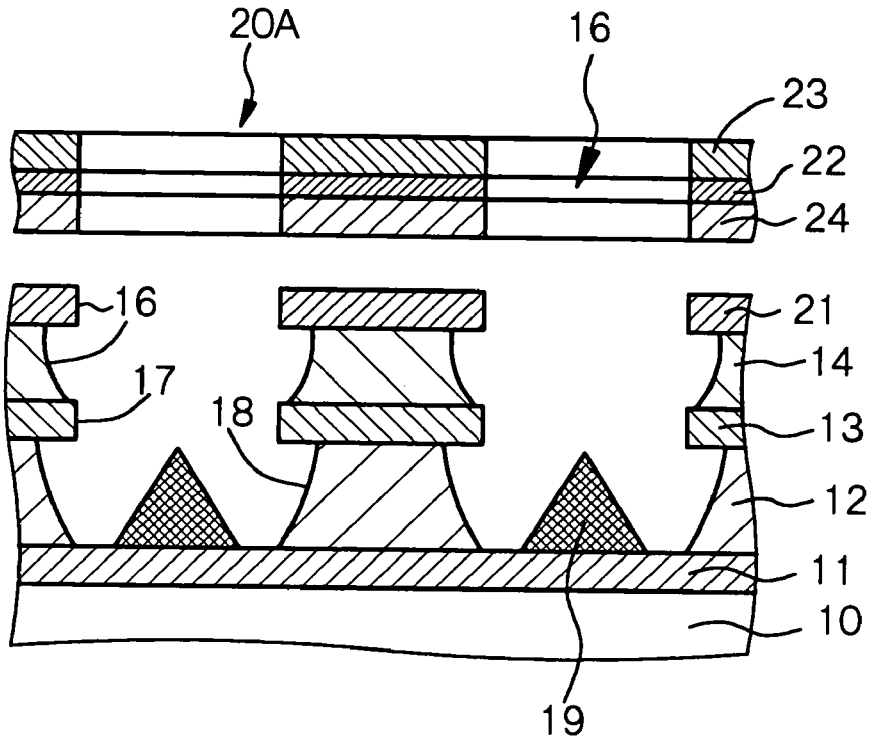
FIG. 23A is a drawing for showing a partial cross section of the stacked structure before a metal layer is fixed to a focus-electrode main portion and a partial end view of a field emission device in Example 4.
Figure 23B:
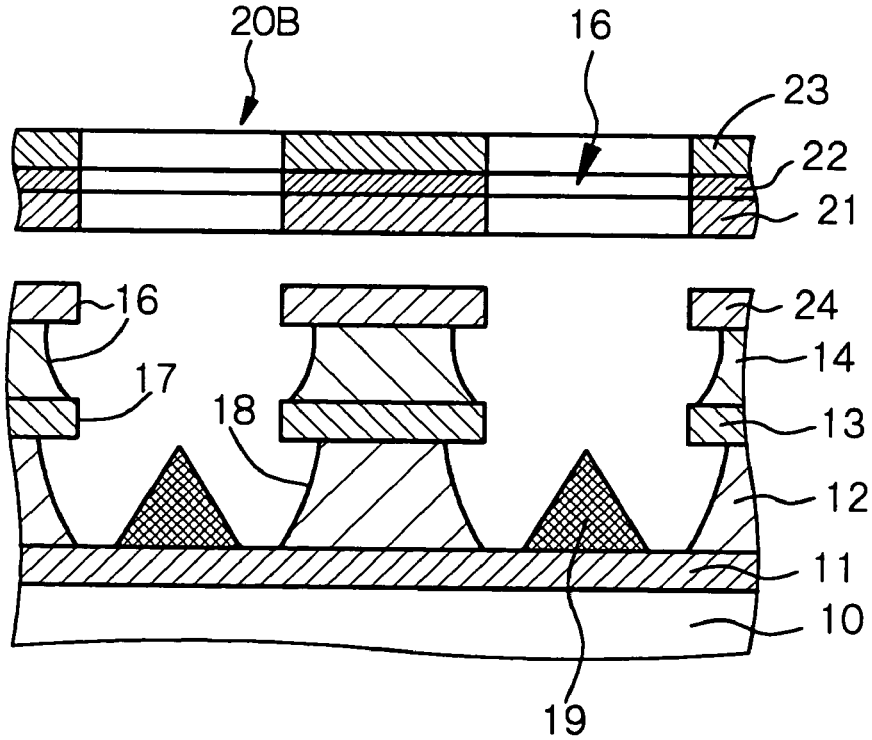
FIG. 23B is a drawing for showing a partial cross section of a stacked structure before a focus-electrode main portion is fixed to a metal layer and a partial end view of a field emission device in Example 5.
Figure 24A:
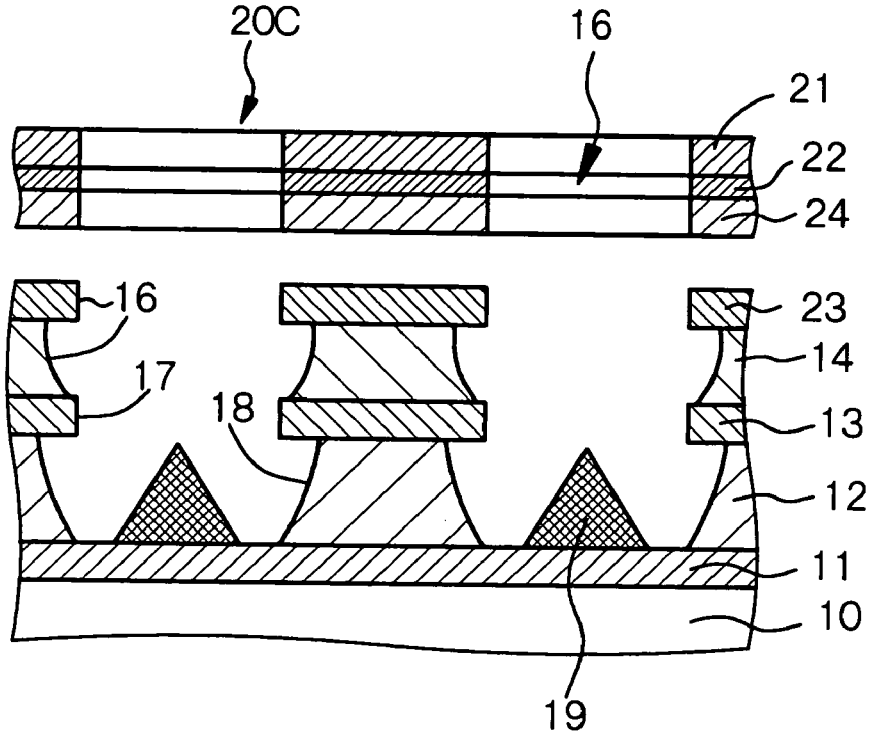
FIG. 24A is a drawing for showing a partial cross section of a stacked structure before a metal layer is fixed to a counterpart electrode and a partial end view of a field emission device in Example 6.
Figure 24B:
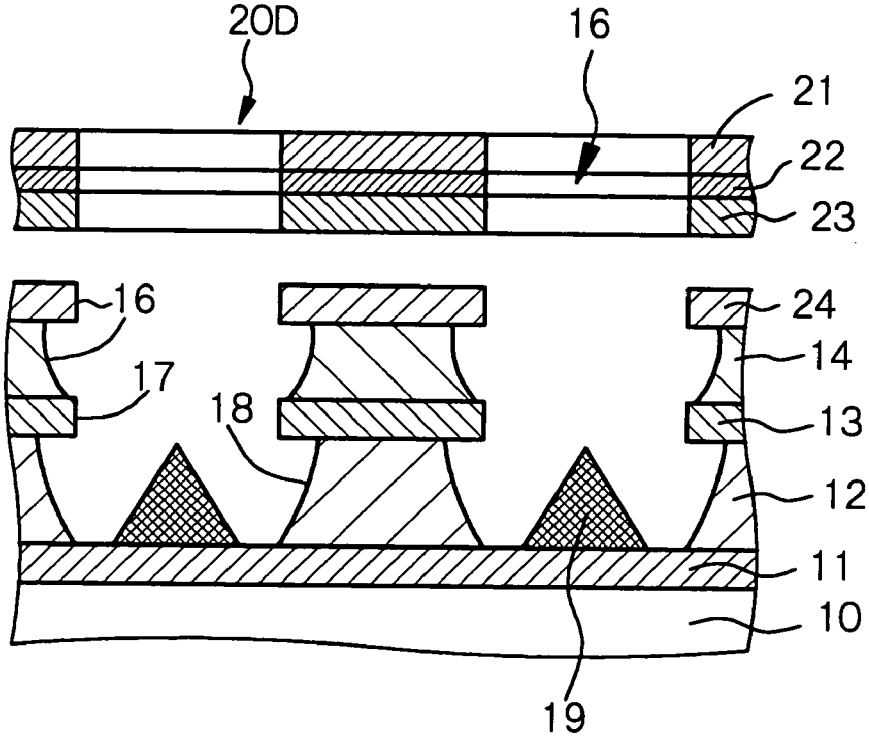
FIG. 24B is a drawing for showing a partial cross section of a stacked structure before a counterpart electrode is fixed to a metal layer and a partial end view of a field emission device in Example 7.
Figure 25A:
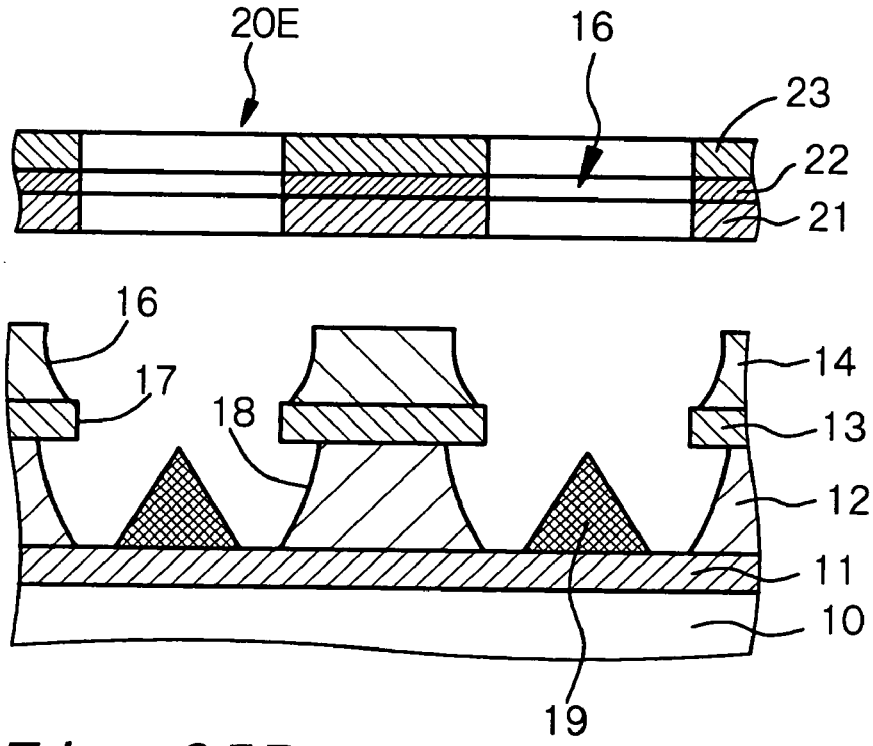
FIG. 25A is a drawing for showing a partial cross section of a stacked structure before a focus-electrode main portion is fixed to an insulating film and a partial end view of a field emission device in Example 8.
Figure 25B:
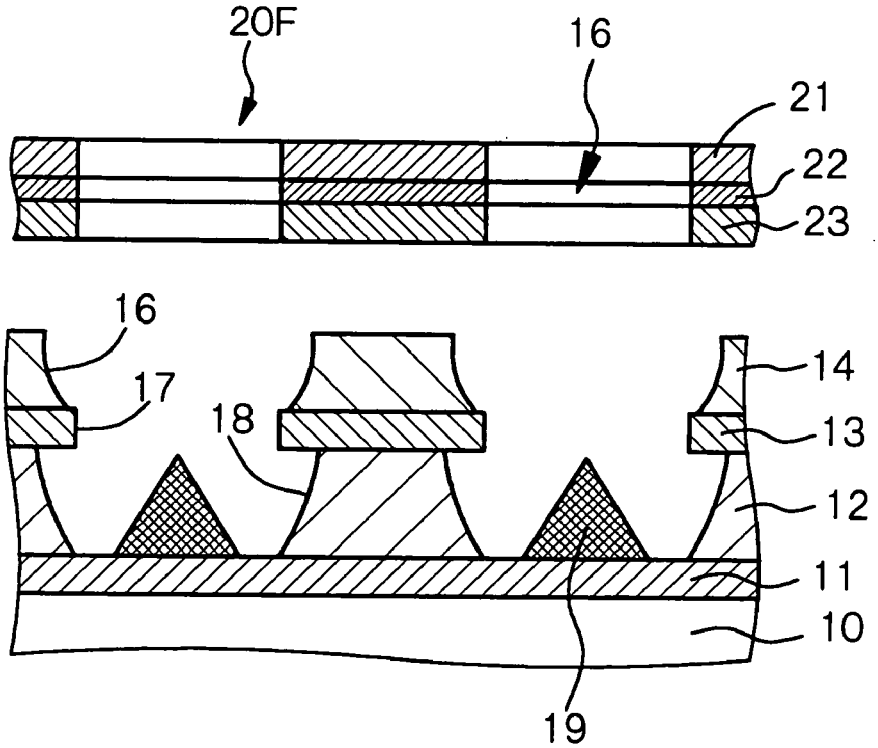
FIG. 25B is a drawing for showing a partial cross section of a stacked structure before a counterpart electrode is fixed to an insulating film and a partial end view of a field emission device in Example 9.
Figure 26:
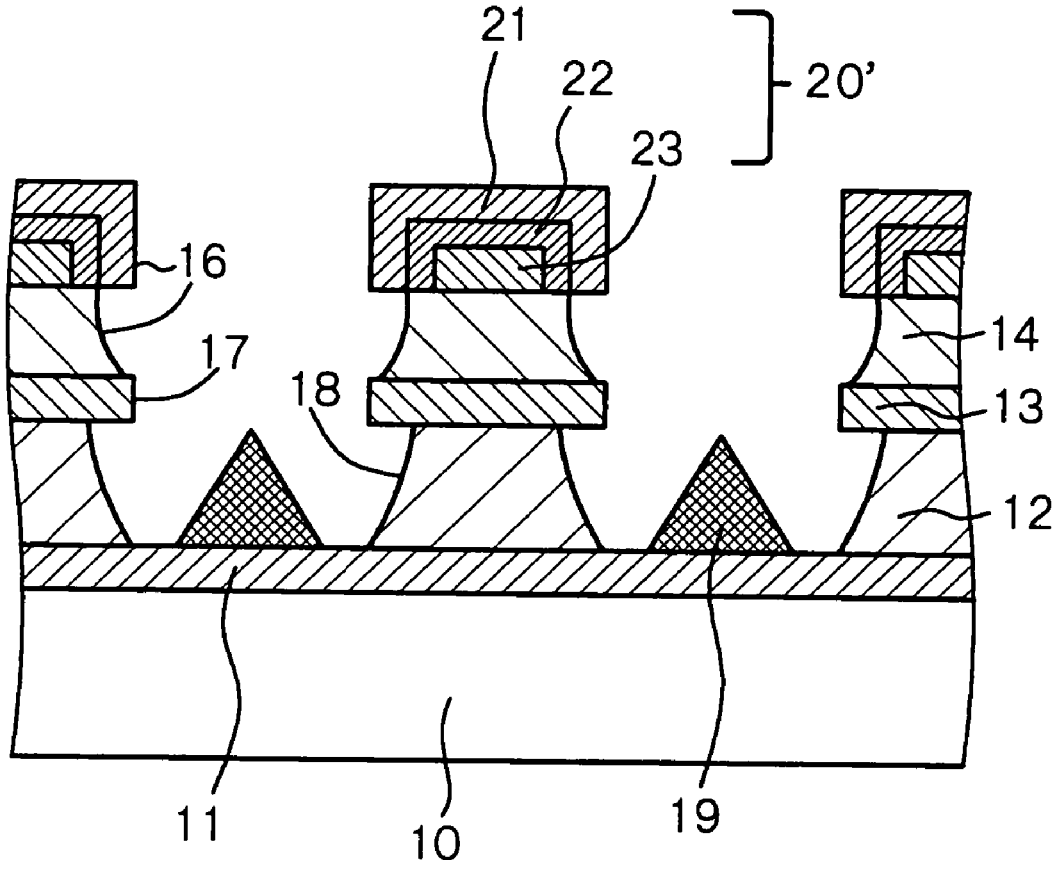
FIG. 26 is a schematic partial end view of a cold cathode field emission device in Example 10.
Figure 27A:
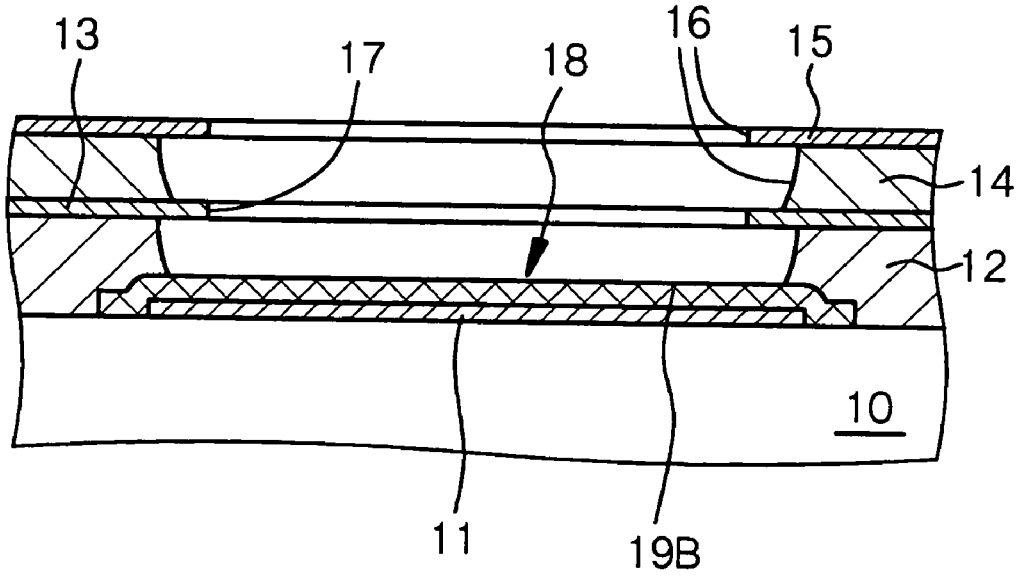
FIG. 27A is a schematic partial cross-sectional view of a plane-type cold cathode field emission device different from the counterpart in Example 2.
Figure 27B:
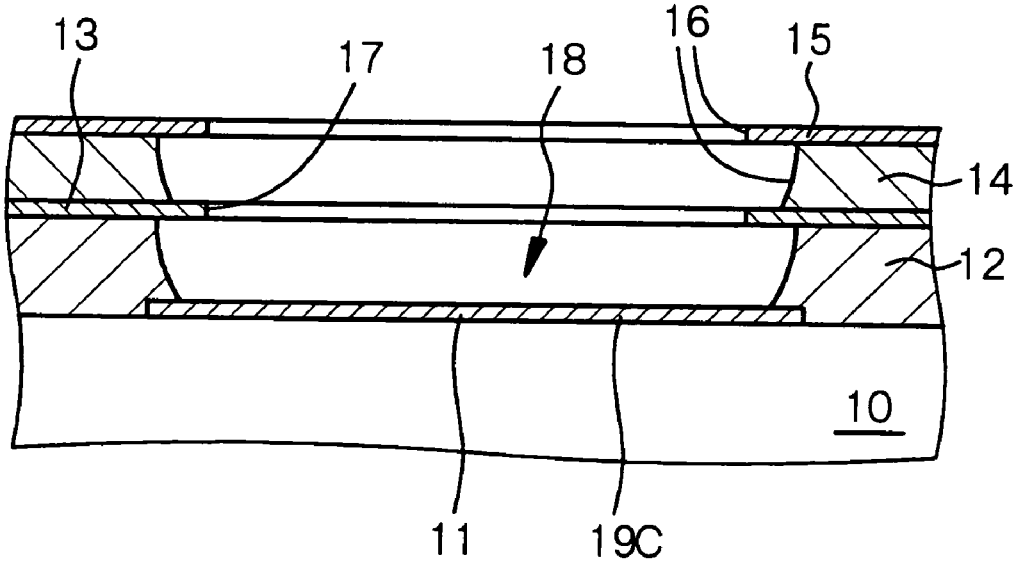
FIG. 27B is a schematic partial cross-sectional view of a flat-type cold cathode field emission device different from the counterpart in Example 2.
Figure 28:
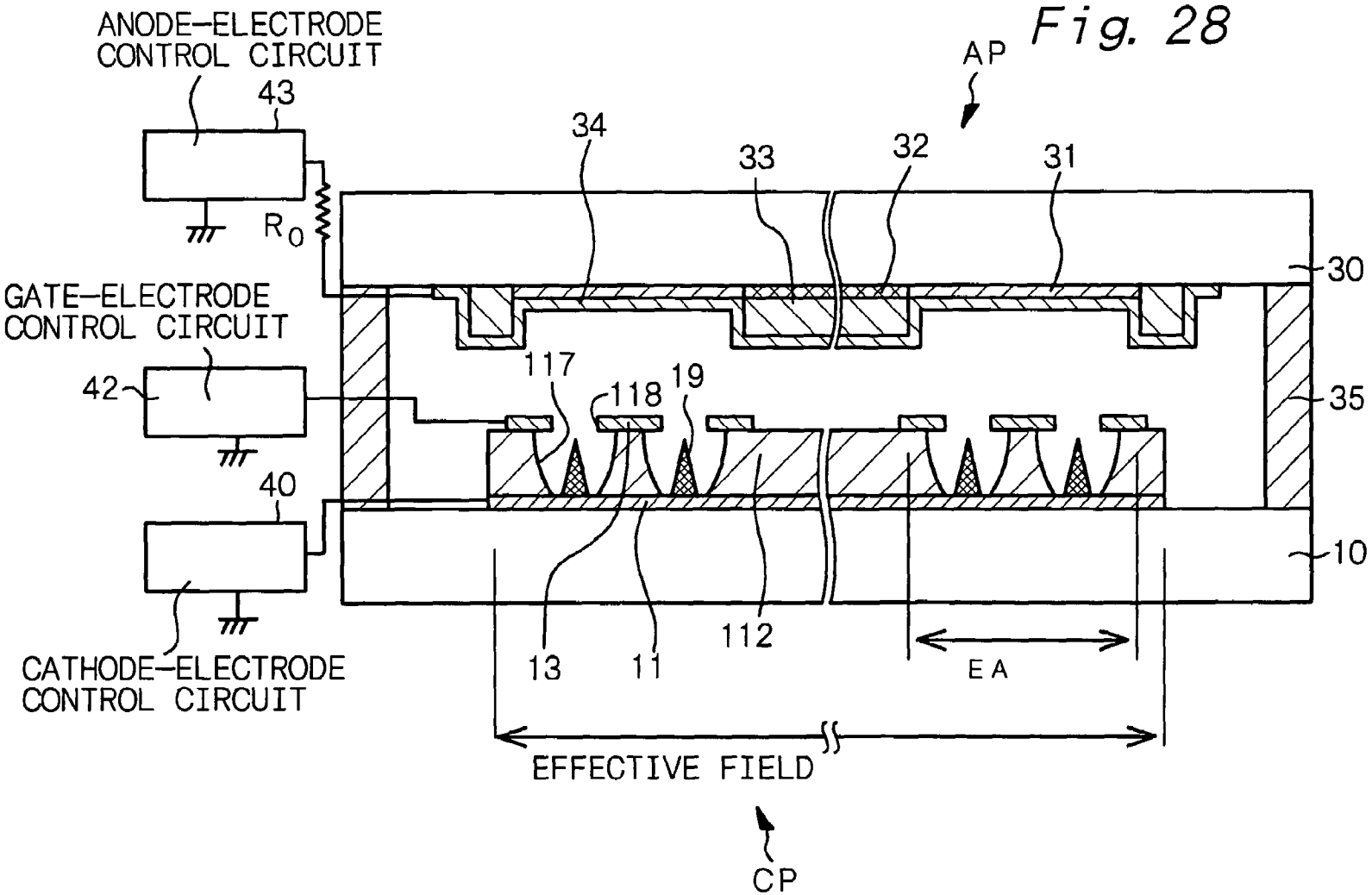
FIG. 28 is a schematic partial end view of a display panel for constituting a cold cathode field emission display having a conventional cold cathode field emission device.

An electron-emitting portion 19A constituting the plane-type field emission device in Example 2 comprises a matrix 52 and a carbon-nanotube structure (specifically, a carbon-nanotube 53) embedded in the matrix 52 in a state where the top portion of the carbon-nanotube structure is projected, and the matrix 52 is formed from an electrically conductive metal oxide (specifically, oxide-tin oxide, ITO) as shown in a schematic partial end view of FIG. 18B.

The production method of the field emission device will be explained with reference to FIGS. 17A, 17B, 18A and 18B, hereinafter.

[Step-200]

First, a stripe-shaped cathode electrode 11 made of an approximately 0.2 μm thick chromium (Cr) layer is formed on a supporting member 10 made, for example, of a glass substrate, for example, by a sputtering method and an etching technique.

[Step-210]

Then, a metal compound solution consisting of an organic acid metal compound solution in which the carbon-nanotube structure is dispersed is applied onto the cathode electrode 11, for example, by a spray method. Specifically, a metal compound solution shown in Table 1 is used. In the metal compound solution, the organic tin compound and the organic indium compound are in a state where they are dissolved in an acid (for example, hydrochloric acid, nitric acid or sulfuric acid). The carbon-nanotube is produced by an arc discharge method and has an average diameter of 30 nm and an average length of 1 μm. In the application, the supporting member 10 is heated to 70–150° C. Atmospheric atmosphere is employed as an application atmosphere. After the application, the supporting member 10 is heated for 5 to 30 minutes to fully evaporate butyl acetate off. When the supporting member 10 is heated during the application as described above, the applied solution begins to dry before the carbon-nanotube is self-leveled toward the horizontal direction of the surface of the cathode electrode 11. As a result, the carbon-nanotube can be arranged on the surface of the cathode electrode 11 in a state where the carbon-nanotube is not in a level position. That is, the carbon-nanotube can be aligned in the direction in which the top portion of the carbon-nanotube faces the anode electrode 34, in other words, the carbon-nanotube comes close to the normal direction of the supporting member 10. The metal compound solution having a composition shown in Table 1 may be prepared beforehand, or a metal compound solution containing no carbon-nanotube may be prepared beforehand and the carbon-nanotube and the metal compound solution may be mixed before the application. For improving dispersibility of the carbon-nanotube, ultrasonic wave may be applied when the metal compound solution is prepared.

TABLE 1

| | |
|---|---|
| Organic tin compound and organic indium compound | 0.1–10 parts by weight |
| Dispersing agent (sodium dodecylsulfate) | 0.1–5 parts by weight |
| Carbon-nanotube | 0.1–20 parts by weight |
| Butyl acetate | Balance |

When a solution of an organic tin compound dissolved in an acid is used as an organic acid metal compound solution, tin oxide is obtained as a matrix. When a solution of an organic indium compound dissolved in an acid is used, indium oxide is obtained as a matrix. When a solution of an organic zinc compound dissolved in an acid is used, zinc oxide is obtained as a matrix. When a solution of an organic antimony compound dissolved in an acid is used, antimony oxide is obtained as a matrix. When a solution of an organic antimony compound and an organic tin compound dissolved in an acid is used, antimony-tin oxide is obtained as a matrix. Further, when an organic tin compound is used as an organic metal compound solution, tin oxide is obtained as a matrix. When an organic indium compound is used, indium oxide is obtained as a matrix. When an organic zinc compound is used, zinc oxide is obtained as a matrix. When an organic antimony compound is used, antimony oxide is obtained as a matrix. When an organic antimony compound and an organic tin compound are used, antimony-tin oxide is obtained as a matrix. Alternatively, a solution of metal chloride (for example, tin chloride or indium chloride) may be used.

After the metal compound solution is dried, salient convexo-concave shapes may be formed in the surface of the metal compound layer in some cases. In such cases, it is desirable to apply the metal compound solution again on the metal compound layer without heating the supporting member 10.

[Step-220]

Then, the metal compound composed of the organic acid metal compound is fired, to give an electron-emitting portion 19A having the carbon-nanotubes 53 fixed onto the surface of the cathode electrode 11 with a matrix 52 (which is specifically a metal oxide, and more specifically, ITO) containing metal atoms (specifically, In and Sn) derived from the organic acid metal compound. The firing is carried out in an atmospheric atmosphere at 350° C. for 20 minutes. The thus-obtained matrix 52 had a volume resistivity of $5\times10^{-7}$ Ω·m. When the organic acid metal compound is used as a starting material, the matrix 52 made of ITO can be formed at a low firing temperature of as low as 350° C. The organic acid metal compound solution may be replaced with an organic metal compound solution. When a solution of metal chloride (for example, tin chloride and indium chloride) is used, the matrix 52 made of ITO is formed while the tin chloride and indium chloride are oxidized by the firing.

[Step-230]

Then, a resist layer is formed on the entire surface, and the circular resist layer having a diameter, for example, of 10 μm is retained above a desired region of the cathode electrode 11. The matrix 52 is etched with hydrochloric acid having a temperature of 10 to 60° C. for 1 to 30 minutes, to remove an unnecessary portion of the electron-emitting portion. Further, when the carbon-nanotubes still remain in a region different from the desired region, the carbon-nanotubes are etched by an oxygen plasma etching treatment under a condition shown in Table 2. A bias power may be 0 W, i.e., direct current, while it is desirable to apply the bias power. The supporting member 10 may be heated, for example, to approximately 80° C.

TABLE 2

| | |
|---|---|
| Apparatus to be used | RIE apparatus |
| Gas to be introduced | Gas containing oxygen |
| Plasma exciting power | 500 W |
| Bias power | 0–150 W |
| Treatment time period | at least 10 seconds |

Alternatively, the carbon-nanotubes can be etched by a wet etching treatment under a condition shown in Table 3.

TABLE 3

| | |
|---|---|
| Solution to be used | $KMnO_4$ |
| Temperature | 20–120° C. |
| Treatment time period | 10 seconds–20 minutes |

Figure 17A:
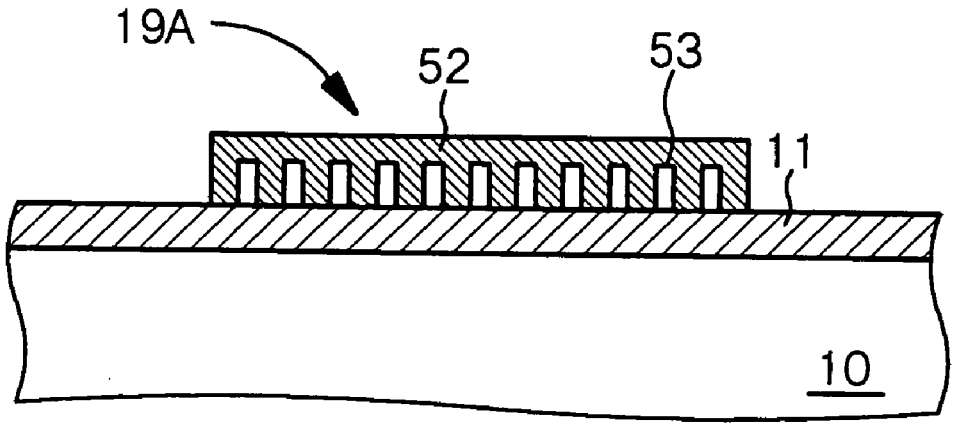
FIGS. 17A and 17B are schematic partial end views of a supporting member, etc., for explaining a method of manufacturing a plane-type cold cathode field emission device in Example 2.
Figure 17B:
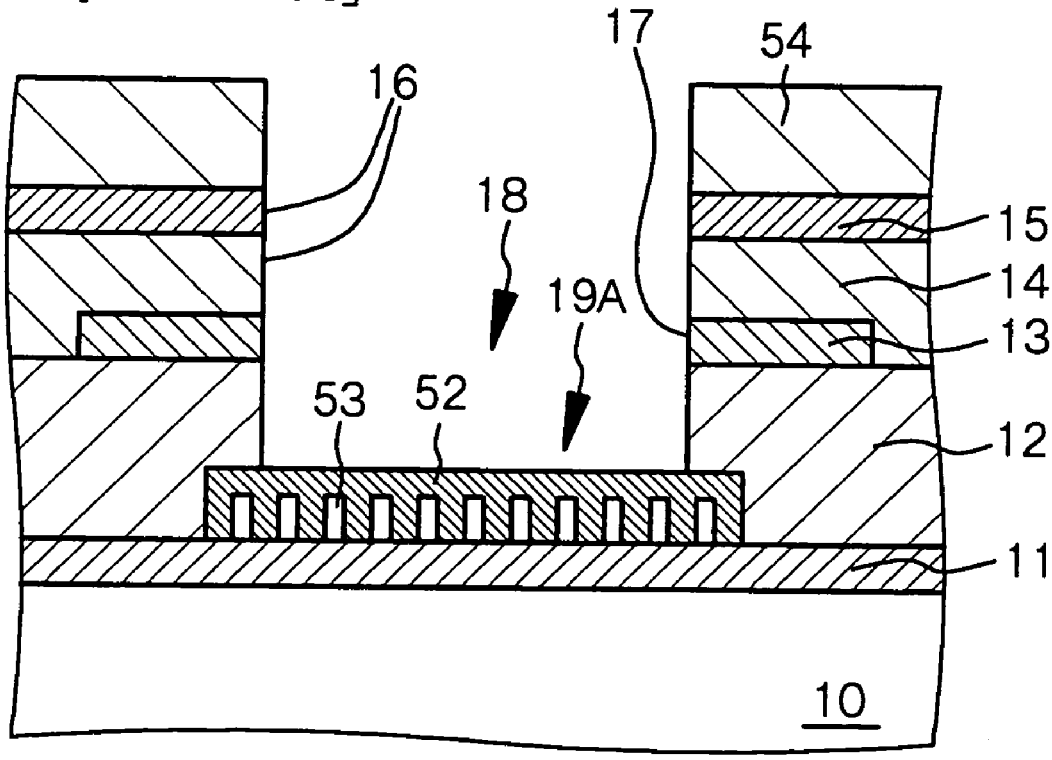

Then, the resist layer is removed, whereby a structure shown in FIG. 17A can be obtained. It is not necessarily required to retain a circular electron-emitting portion having a diameter of 10 μm. For example, the electron-emitting portion 19A may be retained on the cathode electrode 11.

The process may be carried out in the order of [Step-210], [Step-230] and [Step-220].

[Step-240]

An insulating layer 12 is formed on the electron-emitting portion 19A, the supporting member 10 and the cathode electrode 11. Specifically, an approximately 1 μm thick insulating layer 12 is formed on the entire surface by a CVD method using, for example, tetraethoxysilane (TEOS) as a source gas.

The invention claimed is:

1. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, (C) a resistance element, and (D) a capacitor, each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film positioned therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode being connected to a first voltage-output portion of the focus-electrode control circuit through the resistance element, and the focus electrode being further connected to a second voltage-output portion of the focus-electrode control circuit through the capacitor, in which when the capacity of the capacitor is $C_C$ and when the electrostatic capacity based on the anode electrode and the focus electrode is $C_{AF}$, $C_C>20C_{AF}$ is satisfied.

2. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, (C) a resistance element, and (D) a capacitor, each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film positioned therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode being connected to a first voltage-output portion of the focus-electrode control circuit through the resistance element, and the focus electrode being further connected to a second voltage-output portion of the focus-electrode control circuit through the capacitor, in which the capacity $C_C$ of the capacitor is 2 nF to 1 μF.

3. The cold cathode field emission display according to any one of claims 1 or 2, in which when the first voltage-output portion of the focus-electrode control circuit outputs a voltage V1 and when the second voltage-output portion of the focus-electrode control circuit outputs a voltage V2, $V2<0$ and $|V1|-|V2|<0$.

4. The cold cathode field emission display according to claim 3, in which the value of $|V1|-|V2|$ is $-1\times10$ volts to $-1\times10^3$ volts.

5. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, (C) a resistance element, and (D) a capacitor, each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film positioned therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode being connected to a first voltage-output portion of the focus-electrode control circuit through the resistance element, and the focus electrode being further connected to a second voltage-output portion of the focus-electrode control circuit through the capacitor, in which a plurality of the first opening portions are formed through that portion of the focus electrode that is positioned in the overlap region of the cathode electrode and the gate electrode and through the insulating film positioned therebelow, and one second opening portion is communicating with one first opening portion, in which when the capacity of the capacitor is $C_C$ and when the electrostatic capacity based on the anode electrode and the focus electrode is $C_{AF}$, $C_C > 20C_{AF}$ is satisfied.

6. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, (C) a resistance element, and (D) a capacitor, each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film positioned therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode being connected to a first voltage-output portion of the focus-electrode control circuit through the resistance element, and the focus electrode being further connected to a second voltage-output portion of the focus-electrode control circuit through the capacitor, in which a plurality of the first opening portions are formed through that portion of the focus electrode that is positioned in the overlap region of the cathode electrode and the gate electrode and through the insulating film positioned therebelow, and one second opening portion is communicating with one first opening portion, in which the capacity $C_C$ of the capacitor is 2 nF to 1 μF.

7. The cold cathode field emission display according to any one of claims 5 or 6, in which when the first voltage-output portion of the focus-electrode control circuit outputs a voltage V1 and when the second voltage-output portion of the focus-electrode control circuit outputs a voltage V2, $V2<0$ and $|V1|-|V2|<0$.

8. The cold cathode field emission display according to claim 7, in which the value of $|V1|-|V2|$ is $-1\times10$ volts to $-1\times10^3$ volts.

9. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, (C) a resistance element, and (D) a capacitor, each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film positioned therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode being connected to a first voltage-output portion of the focus-electrode control circuit through the resistance element, and the focus electrode being further connected to a second voltage-output portion of the focus-electrode control circuit through the capacitor, in which one first opening portion is formed through that portion of the focus electrode that is positioned in the overlap region of the cathode electrode and the gate electrode and through the insulating film positioned therebelow, and a plurality of the second opening portions are communicating with one first opening portion, and in which when the capacity of the capacitor is $C_C$ and when the electrostatic capacity based on the anode electrode and the focus electrode is $C_{AF}$, $C_C<20C_{AF}$ is satisfied.

10. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, (C) a resistance element, and (D) a capacitor, each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film positioned therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode being connected to a first voltage-output portion of the focus-electrode control circuit through the resistance element, and the focus electrode being further connected to a second voltage-output portion of the focus-electrode control circuit through the capacitor, 1 in which one first opening portion is formed through that portion of the focus electrode that is positioned in the overlap region of the cathode electrode and the gate electrode and through the insulating film positioned therebelow, and a plurality of the second opening portions are communicating with one first opening portion, and in which the capacity $C_C$ of the capacitor is 2 nF to 1 μF.

11. The cold cathode field emission display according to any one of claims 9 or 10, in which when the first voltage-output portion of the focus-electrode control circuit outputs a voltage V1 and when the second voltage-output portion of the focus-electrode control circuit outputs a voltage V2, $V2<0$ and $|V1|-|V2|<0$.

12. The cold cathode field emission display according to claim 11, in which the value of $|V1|-|V2|$ is $-1\times10$ volts to $-1\times10^3$ volts.

13. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the ode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which when the capacity of the capacitor formed by the focus-electrode main portion, the dielectric material layer and the counterpart electrode is $C_C$ and when the electrostatic capacity based on the anode electrode and the focus electrode is $C_{AF}$, $C_C>20C_{AF}$ is satisfied.

14. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which the capacity $C_C$ of the capacitor formed by focus-electrode main portion, the dielectric material layer and the counterpart electrode is 2 nF to 1 μF.

15. The cold cathode field emission display according to any one of claims 13 or 14, in which when the first voltage-output portion of the focus-electrode control circuit outputs a voltage V1 and when the second voltage-output portion of the focus-electrode control circuit outputs a voltage V2, V2<0 and |V1|−|V2|<0.

16. The cold cathode field emission display according to claim 15, in which the value of |V1|−|V2| is $-1\times10$ volts to $-1\times10^3$ volts.

17. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which a plurality of the first opening portions are formed through that portion of the focus electrode that is positioned in the overlap region of the cathode electrode and the gate electrode and through the insulating film positioned therebelow, and one second opening portion is communicating with one first opening portion, and in which when the capacity of the capacitor formed by the focus-electrode main portion, the dielectric material layer and the counterpart electrode is $C_C$ and when the electrostatic capacity based on the anode electrode and the focus electrode is $C_{AF}$, $C_C>20C_{AF}$ is satisfied.

18. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which a plurality of the first opening portions are formed through that portion of the focus electrode that is positioned in the overlap region of the cathode electrode and the gate electrode and through the insulating film positioned therebelow, and one second opening portion is communicating with one first opening portion, and in which the capacity $C_C$ of the capacitor formed by focus-electrode main portion, the dielectric material layer and the counterpart electrode is 2 nF to 1 μF.

19. The cold cathode field emission display according to any one of claim 17 or 18, in which when the first voltage-output portion of the focus-electrode control circuit outputs a voltage V1 and when the second voltage-output portion of the focus-electrode control circuit outputs a voltage V2, $V2<0$ and $|V1|-|V2|<0$.

20. The cold cathode field emission display according to claim 19, in which the value of $|V1|-|V2|$ is $-1\times10$ volts to $-1\times10^3$ volts.

21. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which one first opening portion is formed through that portion of the focus electrode that is positioned in the overlap region of the cathode electrode and the gate electrode and through the insulating film positioned therebelow, and a plurality of the second opening portions are communicating with one first opening portion, and in which the focus electrode comprises:

a focus-electrode main portion formed on the insulating film, a stacked structure of a dielectric material layer, a counterpart electrode formed on the upper surface of the dielectric material layer, and a metal layer formed on the undersurface of the dielectric material layer, wherein the metal layer is fixed to the focus-electrode main portion.

22. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which one first opening portion is formed through that portion of the focus electrode that is positioned in the overlap region of the cathode electrode and the gate electrode and through the insulating film positioned therebelow, and a plurality of the second opening portions are communicating with one first opening portion, and in which the focus electrode comprises:

a metal layer formed on the insulating film, a stacked structure of a dielectric material layer, a counterpart electrode formed on the upper surface of the dielectric material layer, and a focus-electrode main portion formed on the undersurface of the dielectric material layer, wherein the focus-electrode main portion is fixed to the metal layer.

23. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which one first opening portion is formed through that portion of the focus electrode that is positioned in the overlap region of the cathode electrode and the gate electrode and through the insulating film positioned therebelow, and a plurality of the second opening portions are communicating with one first opening portion, and in which the focus electrode comprises:

a counterpart electrode formed on the insulating film, a stacked structure of a dielectric material layer, a focus-electrode main portion formed on the upper surface of the dielectric material layer, and a metal layer formed on the undersurface of the dielectric material layer, wherein the metal layer is fixed to the counterpart electrode.

24. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which one first opening portion is formed through that portion of the focus electrode that is positioned in the overlap region of the cathode electrode and the gate electrode and through the insulating film positioned therebelow, and a plurality of the second opening portions are communicating with one first opening portion, and in which the focus electrode comprises:

a metal layer formed on the insulating film, a stacked structure of a dielectric material layer, a focus-electrode main portion formed on the upper surface of the dielectric material layer, and a counterpart electrode formed on the undersurface of the dielectric material layer, wherein the counterpart electrode is fixed to the metal layer.

25. The cold cathode field emission display according to claim 24, in which the focus electrode comprises:

a stacked structure of a dielectric material layer, a counterpart electrode formed on the upper surface of the dielectric material layer, and a focus-electrode main portion formed on the undersurface of the dielectric material layer, wherein the focus-electrode main portion is fixed to the insulating film.

26. The cold cathode field emission display according to claim 24, in which the focus electrode comprises:

a dielectric material layer, a focus-electrode main portion formed on the upper surface of the dielectric material layer, and a counterpart electrode formed on the undersurface of the dielectric material layer, wherein the counterpart electrode is fixed to the insulating film.

27. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which one first opening portion is formed through that portion of the focus electrode that is positioned in the overlap region of the cathode electrode and the gate electrode and through the insulating film positioned therebelow, and a plurality of the second opening portions are communicating with one first opening portion, and in which the focus electrode comprises:

a counterpart electrode formed on the insulating film, a dielectric material layer covering the top surface and side surface of the counterpart electrode, and a focus-electrode main portion formed on the dielectric material layer.

28. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which one first opening portion is formed through that portion of the focus electrode that is positioned in the overlap region of the cathode electrode and the gate electrode and through the insulating film positioned therebelow, and a plurality of the second opening portions are communicating with one first opening portion, and in which when the capacity of the capacitor formed by the focus-electrode main portion, the dielectric material layer and the counterpart electrode is $C_C$ and when the electrostatic capacity based on the anode electrode and the focus electrode is $C_{AF}$, $C_C>20C_{AF}$ is satisfied.

29. A cold cathode field emission display comprising at least:

(A) a display panel having a cathode panel provided with a plurality of electron-emitting regions and an anode panel provided with a phosphor layer and an anode electrode, said cathode panel and said anode panel being bonded to each other in their circumferential regions, (B) a focus-electrode control circuit, and (C) a resistance element, and each electron-emitting region comprising:

(a) a cathode electrode being formed on a supporting member and extending in a first direction, (b) an insulating layer formed on the supporting member and the cathode electrode, (c) a gate electrode being formed on the insulating layer and extending in a second direction different from the first direction, (d) an insulating film formed on the insulating layer and the gate electrode, (e) a focus electrode formed on the insulating film, (f) a first opening portion formed through that portion of the focus electrode that is positioned in an overlap region of the cathode electrode and the gate electrode and through the insulating film formed therebelow, (g) a plurality of second opening portions being formed through that portion of the gate electrode that is positioned in the overlap region of the cathode electrode and the gate electrode and communicating with the first opening portion, (h) a third opening portion being formed through the insulating layer and communicating with the second opening portion, and (i) an electron-emitting portion exposed in the bottom portion of the third opening portion, the focus electrode having a structure in which a focus-electrode main portion, a dielectric material layer and a counterpart electrode are stacked, the focus-electrode main portion, the dielectric material layer and the counterpart electrode constituting a capacitor, the focus-electrode main portion being connected to a first voltage-output portion of the focus-electrode control circuit through the resistance element, and the counterpart electrode being connected to a second voltage-output portion of the focus-electrode control circuit, in which one first opening portion is formed through that portion of the focus electrode that is positioned in the overlap region of the cathode electrode and the gate electrode and through the insulating film positioned therebelow, and a plurality of the second opening portions are communicating with one first opening portion, and in which the capacity $C_C$ of the capacitor formed by focus-electrode main portion, the dielectric material layer and the counterpart electrode is 2 nF to 1 μF.

30. The cold cathode field emission display according to any one of claims 28 or 29, in which when the first voltage-output portion of the focus-electrode control circuit outputs a voltage V1 and when the second voltage-output portion of the focus-electrode control circuit outputs a voltage V2, V2<0 and |V1|−|V2|<0.

31. The cold cathode field emission display according to claim 30, in which the value of |V1|−|V2| is $-1\times10$ volts to $-1\times10^3$ volts.

* * * * *

UNITED STATES PATENT AND TRADEMARK OFFICE

CERTIFICATE OF CORRECTION

PATENT NO. : 7,064,493 B2
APPLICATION NO. : 10/503991
DATED : June 20, 2006
INVENTOR(S) : Morikazu Konishi et al.

It is certified that error appears in the above-identified patent and that said Letters Patent is hereby corrected as shown below:

Column 32:
Line 66, "$C_{AF}$, $C_c$<20$C_{AF}$" should read -- $C_{AF}$, $C_c$>20$C_{AF}$ --.

Column 33:
Line 43, "capacitor, 1" should read -- capacitor, --.

Column 34:
Line 23, "of the ode electrode" should read -- of the cathode electrode --.

Signed and Sealed this

Eighth Day of May, 2007

JON W. DUDAS
*Director of the United States Patent and Trademark Office*